US005370979A

United States Patent [19]

Kume

[11] Patent Number: 5,370,979

[45] Date of Patent: Dec. 6, 1994

[54] SILVER HALIDE COLOR PHOTOGRAPHIC LIGHT-SENSITIVE MATERIAL

[75] Inventor: Yuji Kume, Minami-ashigara, Japan

[73] Assignee: Fuji Photo Film Co., Ltd., Kanagawa, Japan

[21] Appl. No.: 62,600

[22] Filed: May 18, 1993

[30] Foreign Application Priority Data

May 19, 1992 [JP] Japan ..... 4-150013

[51] Int. Cl.[5] ..... G03C 1/46

[52] U.S. Cl. ..... 430/506; 430/504; 430/359; 430/549; 430/553; 430/555; 430/558

[58] Field of Search ..... 430/506, 504, 359, 549, 430/553, 555, 558

[56] References Cited

U.S. PATENT DOCUMENTS 4,647,527 3/1987 Ikenoue et al. ..... 430/504
4,770,980 9/1988 Matejec et al. ..... 430/506

FOREIGN PATENT DOCUMENTS 0456257 11/1991 European Pat. Off. .

OTHER PUBLICATIONS

Patent Abstract of Japan vol. 11, No. 173 (P-581) (2620) 4 Jun. 1987.

Derwent Abstract of JP-62003253, 9 Jan. 1987.

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material has, on a support, at least one green-sensitive silver halide emulsion layer containing a magenta coupler, at least one blue-sensitive silver halide emulsion layer containing a yellow coupler, and at least two red-sensitive silver emulsion layers containing a cyan coupler and having different sensitivities. The highest sensitivity layer of the red-sensitive silver halide emulsion layers contains a magenta coupler, and a red-sensitive emulsion layer having a lower sensitivity contains a magenta colored cyan coupler.

13 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a color photographic light-sensitive material having a high sensitivity, a high sharpness, and an improved print quality.

2. Description of the Related Art

Recently, in accordance with an increase in the sensitivity of the color negative photographic light-sensitive material, the graininess and sharpness have been greatly improved. For the purpose of increasing the color reproducibility, many attempts have been conducted to improve the color saturation by enhancing a masking using a colored coupler, as disclosed, in, e.g., JP-A-61-221748, JP-A-62-3253, JP-A-61-43743, JP-A-62-160448 and JP-A-160449.

However, the enhancement of a masking using a magenta colored coupler entails the drawback of a decrease in the sensitivity of a red-sensitive layer. JP-A-1-128067 discloses a technique of making the ratio of the magenta colored cyan coupler in a lower-speed red-sensitive silver halide emulsion layer, higher than that of a higher-speed red-sensitive emulsion layer. JP-A-2-190847 discloses a technique of adding 80 wt % or more of the total magenta colored cyan coupler to the second highest red-sensitive silver halide emulsion layer of the three-layered red-sensitive silver halide emulsion layer unit, to supplement an insufficient masking. However, addition of a magenta colored cyan coupler in a red-sensitive silver halide emulsion layer, by itself, does not solve the problem of a decrease in sensitivity, and a satisfactory sharpness, and print quality cannot be achieved.

SUMMARY OF THE INVENTION

An object of the invention is to provide a color photographic light-sensitive material having a high sensitivity, a high sharpness, and an improved print quality.

The above object of the invention can be achieved by a silver halide color photographic light-sensitive material comprising, on a support, at least one green-sensitive silver halide emulsion layer containing a magenta coupler, at least one blue-sensitive silver halide emulsion layer containing a yellow coupler, and at least two red-sensitive silver emulsion layers containing a cyan coupler and having different sensitivities, wherein, of said red-sensitive silver halide emulsion layers, a red-sensitive emulsion layer having a highest sensitivity contains a magenta coupler, and a red-sensitive emulsion layer having a lower sensitivity contains a magenta colored cyan coupler.

In the present invention, it is preferable that the highest sensitivity emulsion layer of the red-sensitive emulsion layers is located more remotely from the support than the other red-sensitive emulsion layers.

Detailed Description of the Preferred Embodiments

In order to achieve the purpose of the invention more effectively, it is preferable that a compound represented by the following formula (I) is used as a magenta colored coupler.

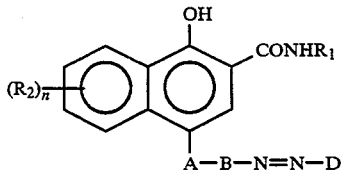

Formula (I)

where $R_1$ represents an aromatic group or a heterocyclic group; $R_2$ represents a group substitutable on the naphthol ring; A—B—N=N—D represents a coupling split-off group; A represents a divalent group, bonding of which with the carbon atom at the coupling active site of the coupler represented by formula (I) is cleaved upon a reaction between the coupler and an oxidized form of a color developing agent; B represents a divalent aromatic group or heterocyclic group; D represents an aromatic group or a heterocyclic group; and n is an integer from 0 to 4.

At least one of the groups represented by A, B, and D in formula (I) contains, as a substituent, a sulfo group, a caboxyl group, or an alkali-metal salt thereof, an ammonium salt thereof, an alkylamine salt thereof, or a pyridinium salt thereof. Owing to these water-soluble groups, the coupling split-off group represented by A—B—N=N—D flows out into a developing solution after being released from the coupler residue.

Examples of the aromatic group represented by $R_1$ are substituted or unsubstituted aromatic groups having 6–30 carbon atoms. Examples of the heterocyclic group are substituted or unsubstituted heterocyclic groups each having a heterocyclic residue of 2–30 carbon atoms, and the heteroatom in the heterocyclic ring may be N, O, S, or Se. Preferably, the heterocyclic group is an unsaturated heterocyclic ring containing a nitrogen atom.

$R_2$ represents a group (which may be an atom hereinafter) which can be substituted on the naphthol ring, and typical examples thereof are a halogen atom, a hydroxy group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, and an imido group. $R_2$ contains 0–30 carbon atoms. In the case where there are two $R_2$'s, an example of cyclic $R_2$ is a dioxymethylene group. Here, an aliphatic group is an aliphatic hydrocarbon group such as an alkyl group, an alkenyl group, or an alkynyl group, and may have a usual substituent.

The magenta colored cyan coupler represented by formula (I) is preferably represented by formula (II).

Formula (II)

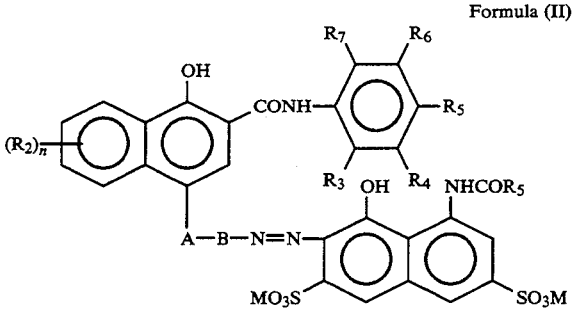

where $R_2$, A, B, and n have the same meaning as those of formula (I); each of $R_3$ and $R_7$ represents $—R_{31}$, $—OR_{31}$, $—SR_{31}$, $—OCOR_{31}$, $—NHSO_2R_{31}$, $—OCO_2R_{31}$, or $—OCONHR_{31}$ wherein $R_{31}$ is a straight or branched alkyl group, with the proviso that $R_3$ and $R_7$ are not hydrogen atoms at the same time; each of $R_4$, $R_5$, and $R_6$ represents a hydrogen atom, a halogen atom, or an alkyl group or alkoxy group each having 1–3 carbon atoms; $R_8$ is an alkyl group having 1–3 carbon atoms; and M represents a hydrogen atom, or a 1/m number of cation having a valence of m.

Specific examples of the magenta colored cyan coupler represented by formula (II) will be listed below.

(1)

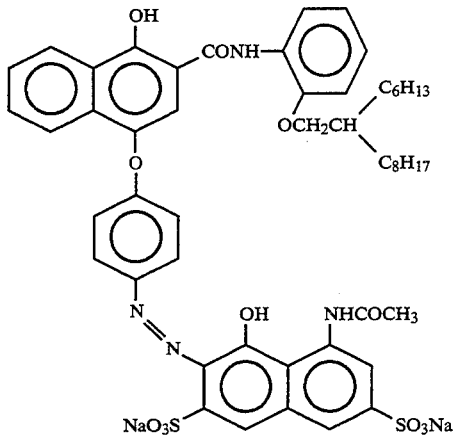

(2)

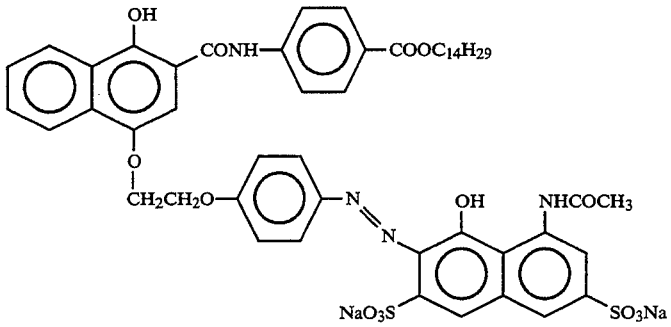

(3)

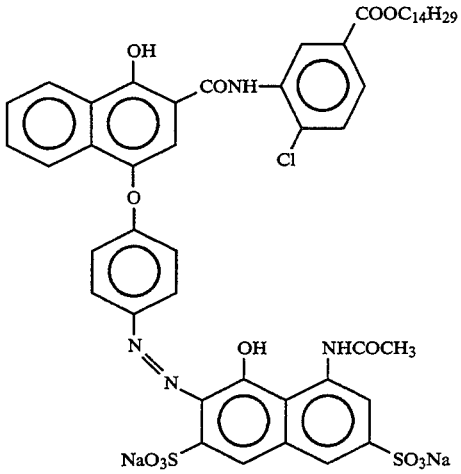

-continued
(4)
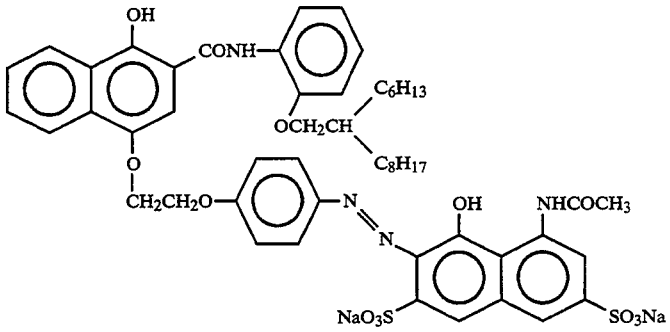
(5)
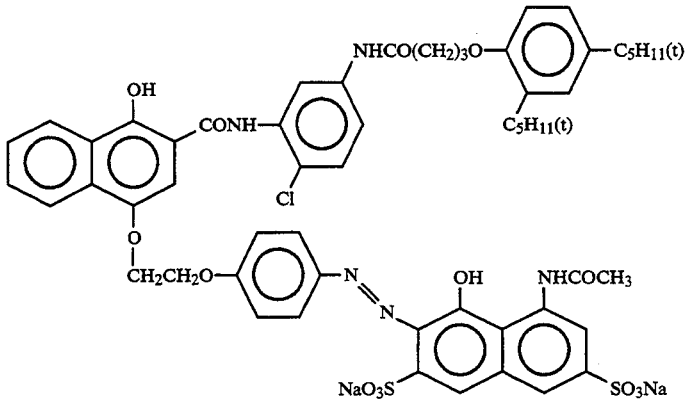
(6)
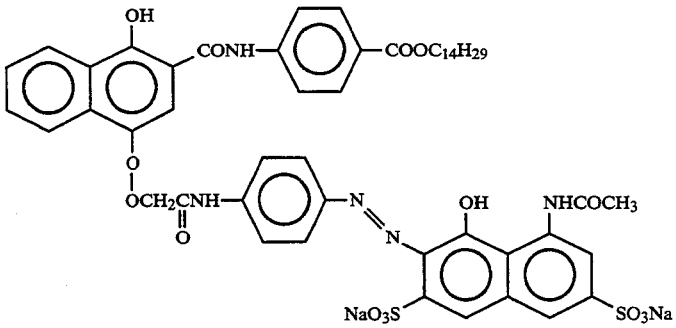
(7)
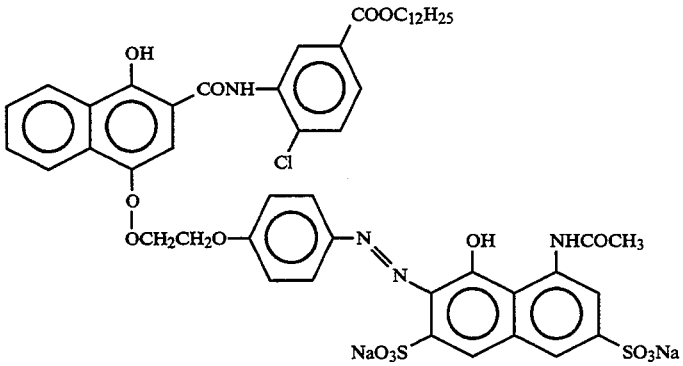

-continued
(8)
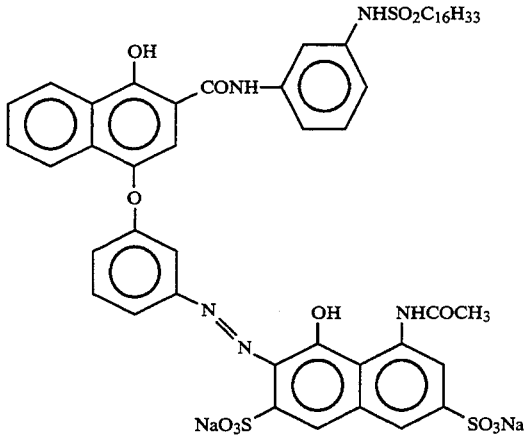
(9)
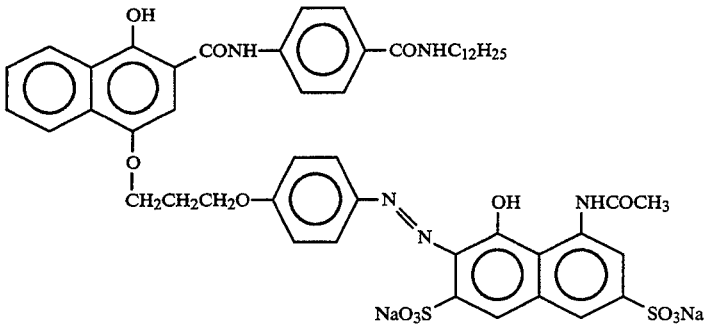
(10)
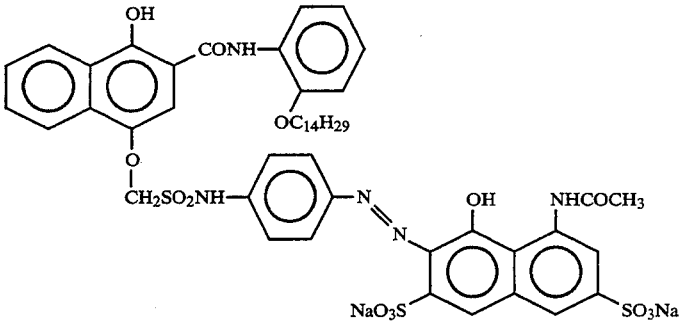
(11)
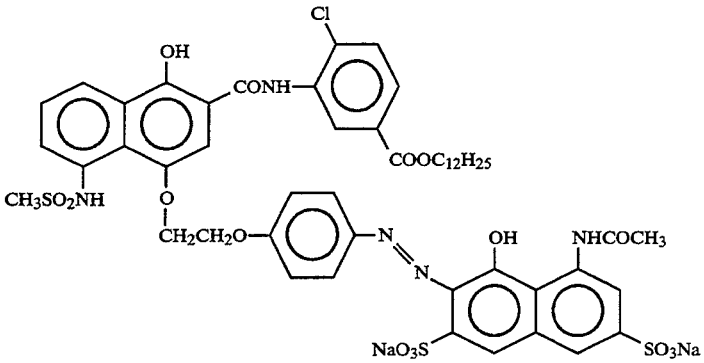

-continued
(12)
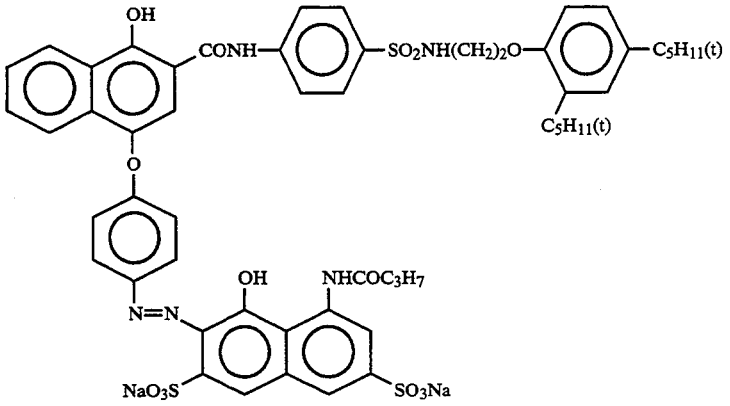
(13)
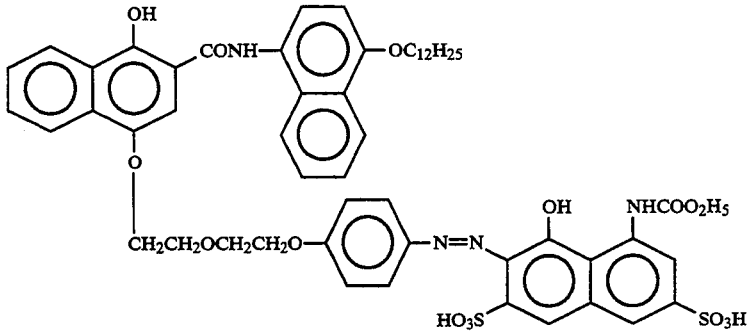
(14)
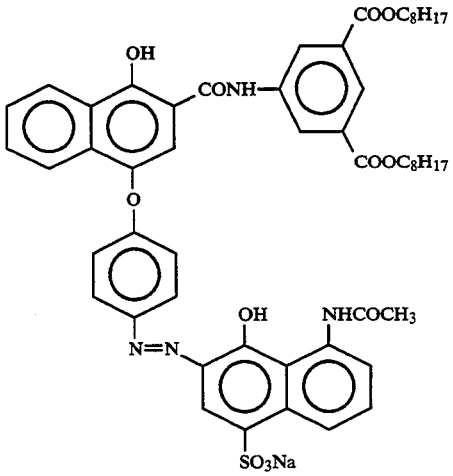
(15)
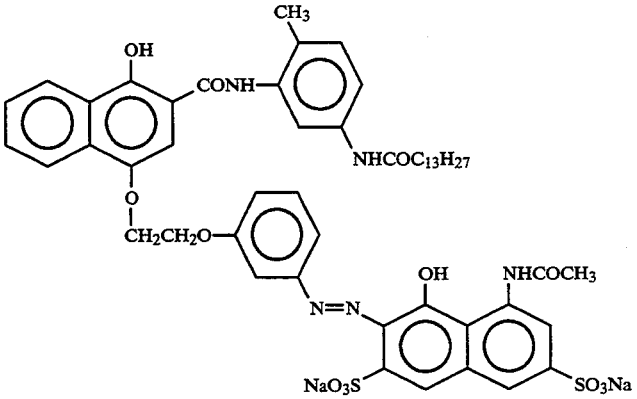

-continued
(16)
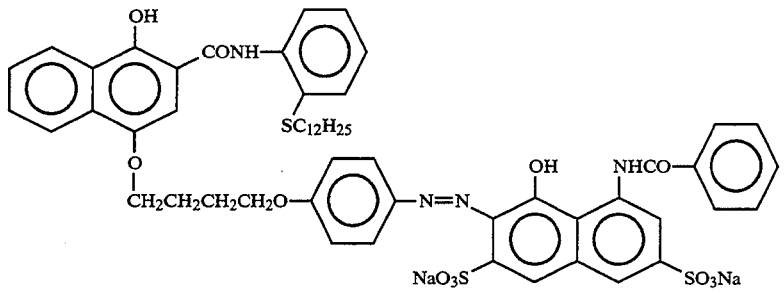
(17)
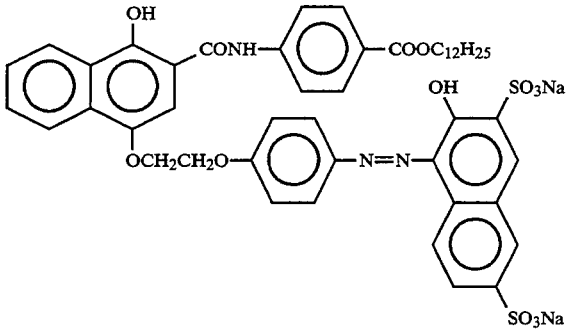
(18)
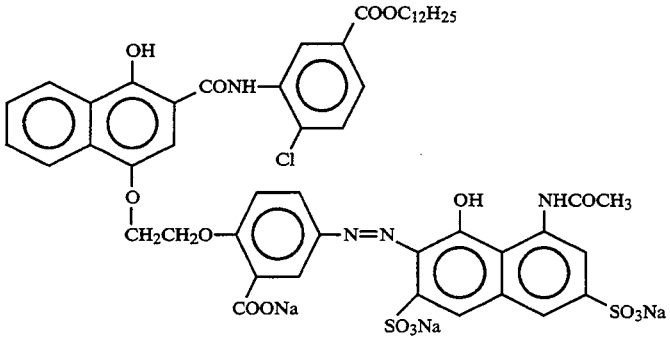
(19)
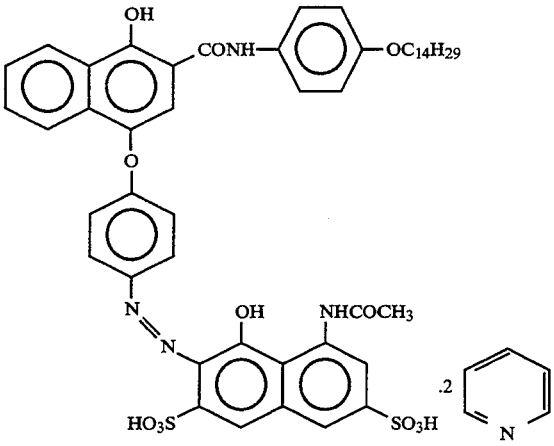

-continued
(20)
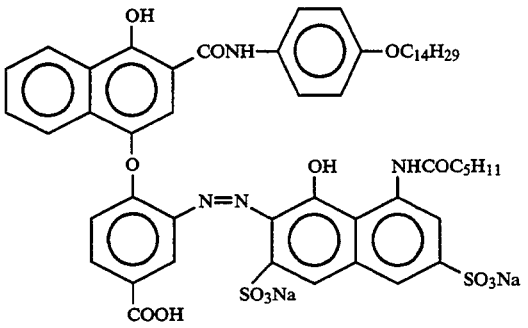
(21)
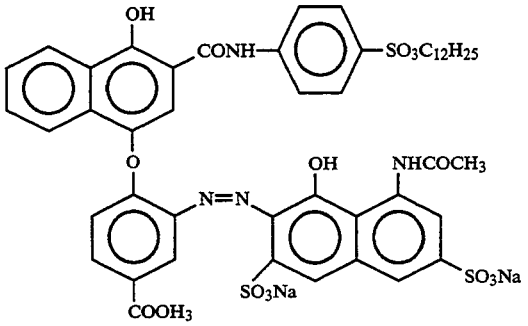
(22)
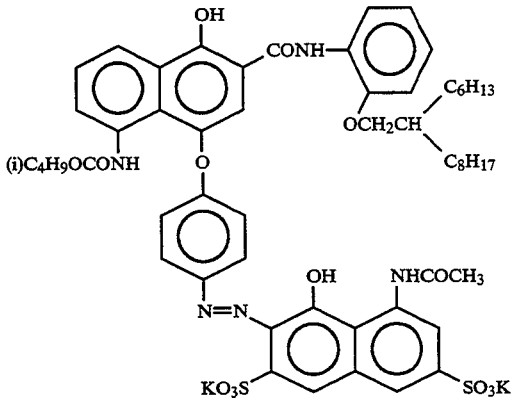
(23)
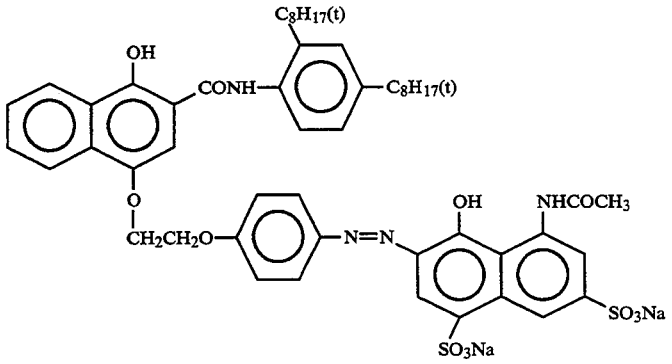

-continued
(24)
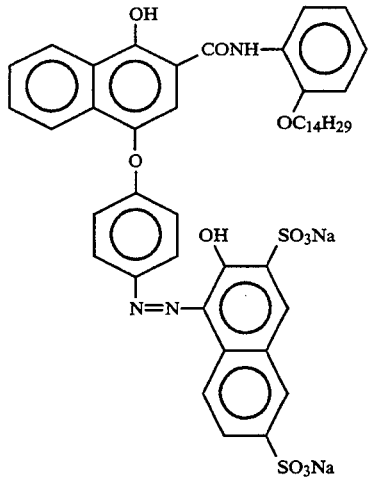
(25)
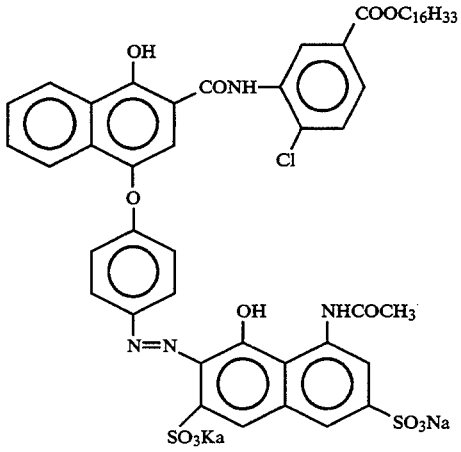
(26)
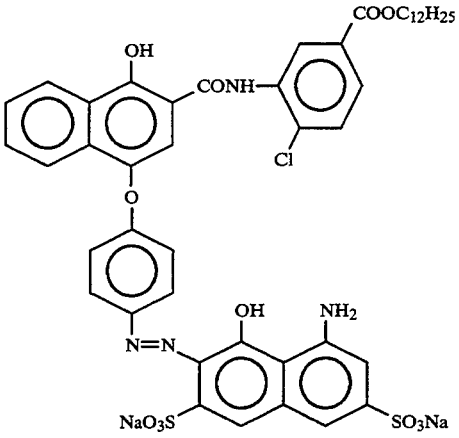

-continued (27)

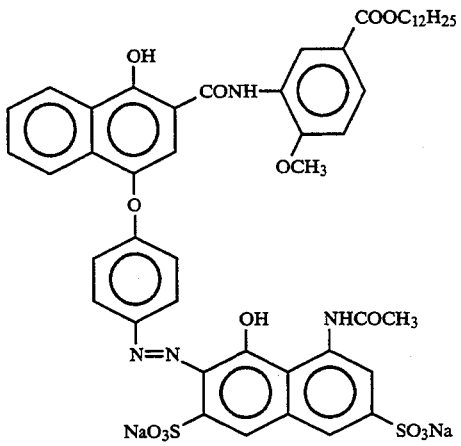

(28)

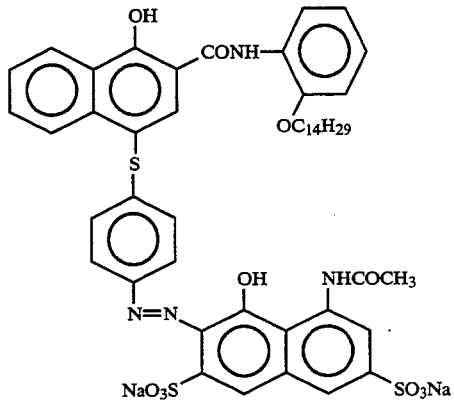

(29)

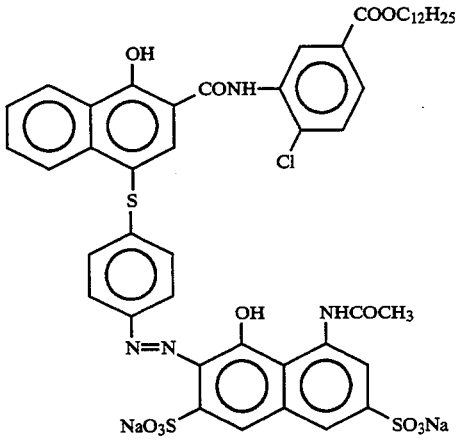

In the present invention, magenta colored cyan couplers other than those magenta coupler represented by the formula (I) can be used, and a preferable example thereof is represented by the following formula (III).

Formula (III)

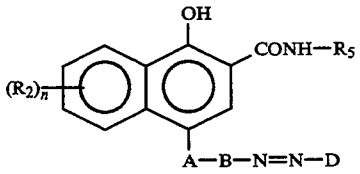

where $R_5$ represents an aliphatic group, or an alicyclic group; $R_6$ represents a group which can be substituted on the naphthol ring; n is an integer of 0–4; and A—B—N=N—D represents a coupling split-off group, as described in connection with formula (I).

Specific examples of the magenta colored cyan coupler represented by formula (III) will be listed below.

(III-1)
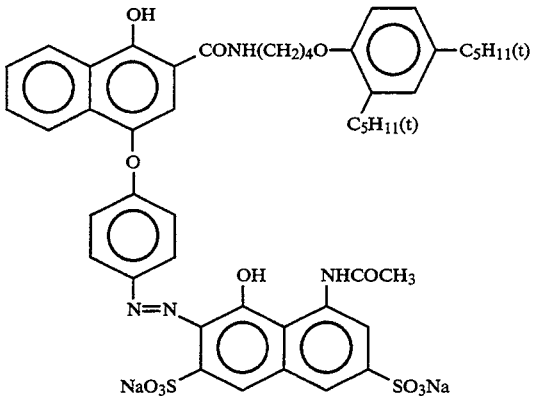
(III-2)
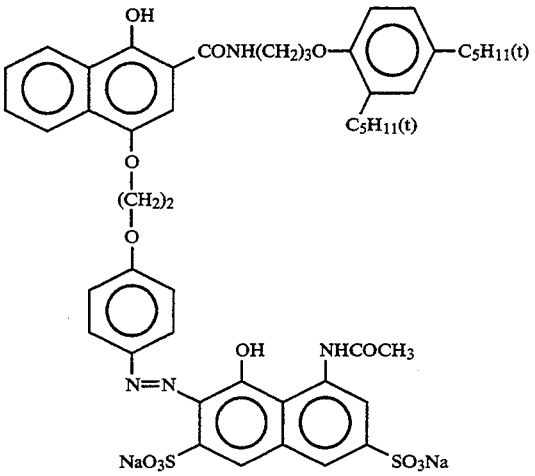
(III-3)
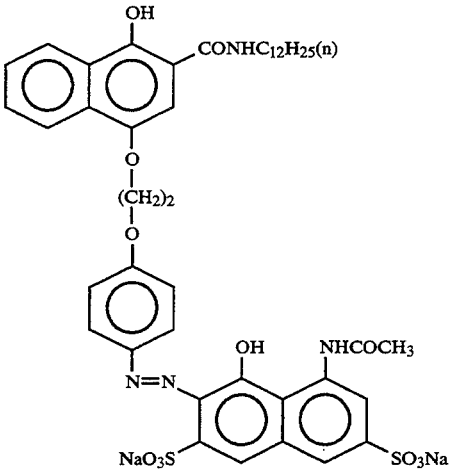

-continued
(III-4)
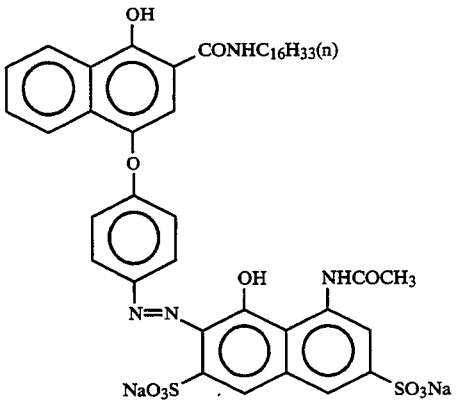
(III-5)
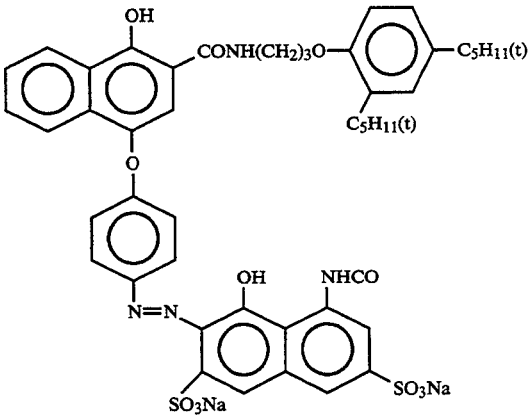
(III-6)
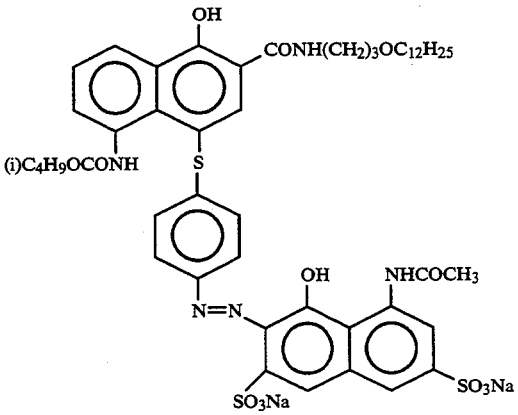
(III-7)
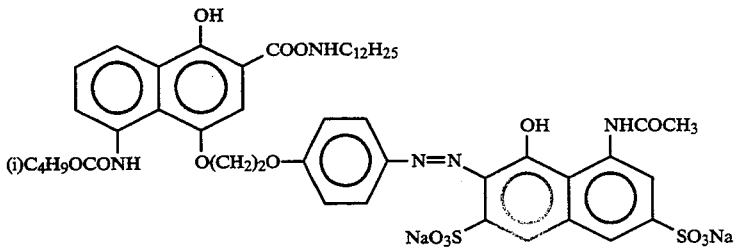

-continued
(III-8)
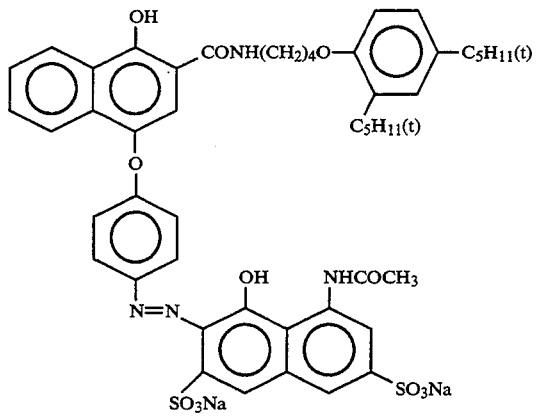
(III-9)
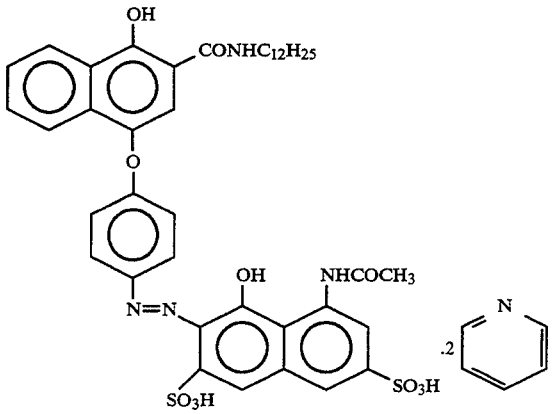
(III-10)
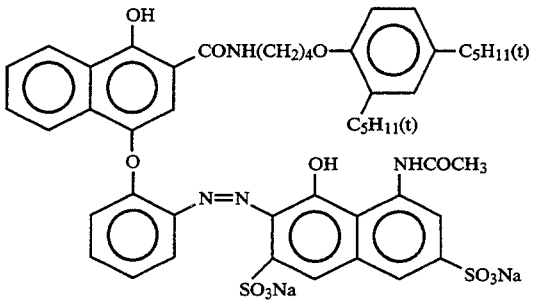
(III-11)
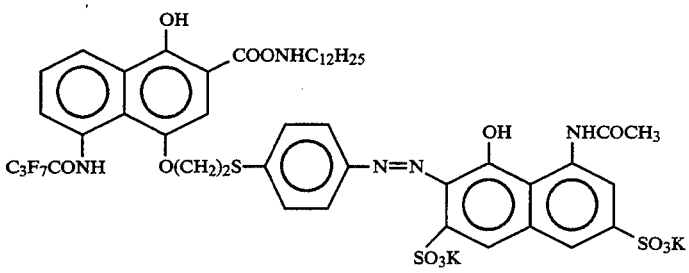

-continued (III-12)

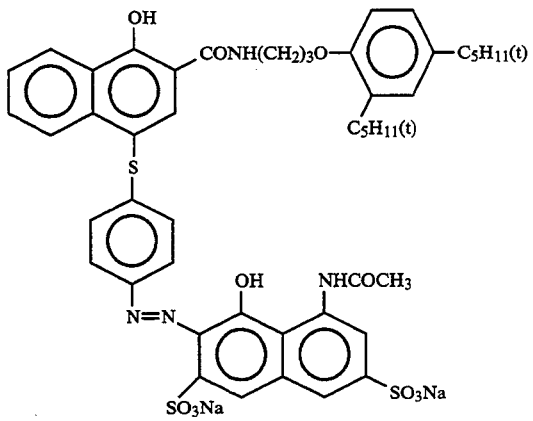

(III-13)

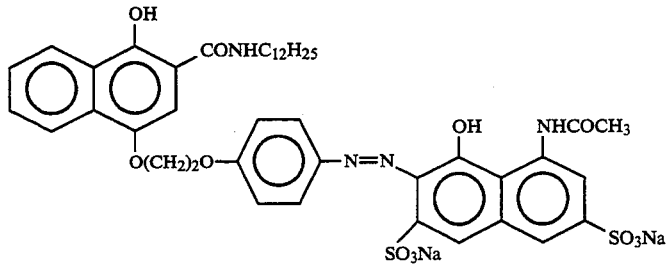

The magenta colored cyan coupler represented by formula (III) is disclosed in, for example, U.S. Pat. Nos. 4,004,929, and 4,138,258, and British Patent 1,146,368.

Other than the above-listed couplers, the following magenta colored cyan coupler, which falls within the scope of formula (I), can be used:

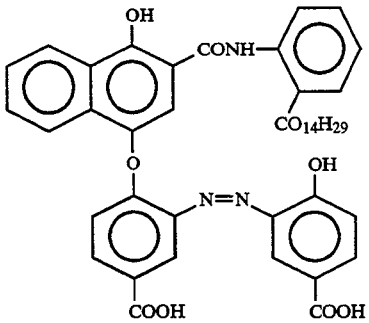

Next, the magenta coupler used in the present invention will be described. The magenta coupler used in the present invention may be any coupler which forms a magenta dye upon coupling with an oxidized form of a developing agent, and preferably used are a 5-pyrazolon magenta coupler, and a pyrazoloazole magenta coupler.

5-pyrazolon magenta coupler can be represented by Formula (m).

Formula (m)

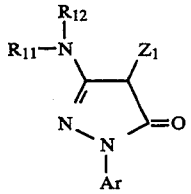

where $R_{11}$ represents an alkyl group, an aryl group, an acyl group, or a carbamoyl group; Ar represents phenyl group, or a phenyl group substituted with one or more of a halogen atom, an alkyl group, a cyano group, an alkoxy group, an alkoxycarbonyl group or an acylamino group; $Z_1$ represents a hydrogen atom or a group which can be split-off upon reacting with an oxidized form of an aromatic primary amine color developing agent.

Of the 5-pyrazolon magenta couplers represented by formula (m), those in which $R_{11}$ represents an aryl group, or an acyl group; Ar represents a phenyl group substituted with one or more halogen atoms (particularly, chlorine atom); $Z_1$ represents a hydrogen atom, or a coupling split-off group which is an alkylthio group, an arylthio group or an azolyl group are preferred.

More specifically, $R_{11}$ and $R_{12}$ are preferably an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl or 2-chloro-5-[2-(4-hydroxy-3-tertbutylphenoxy)tetradecanamido]phenyl, or an acyl group such as acetyl, pivaloyl, tetradecanoyl, 2-(2,4-di-tert-pentylphenoxy)acetyl, 2-(2,4-di-tert-pentylphenoxy)butanoyl, benzoyl, 3-(2,4-di-tert-amylphenoxyacetamido)benzoyl. These groups may contain a substituent, which is an organic group bonded at a carbon atom, oxygen atom, nitrogen atom or sulfur atom, or a halogen atom.

Ar preferably represents a substituted phenyl group such as 2,4,6-trichlorophenyl, 2,5-dichlorophenyl, or 2-chlorophenyl.

A coupling split-off group represented by $Z_1$ is preferably an alkylthio or arylthio group such as dodecylthio, benzylthio, 1-carboxyldodecylthio, phenylthio, 2-butoxy-5-tert-octylphenylthio, 2,5-dioctyloxyphenylthio, 2-(2-ethoxyethoxy)-5-tert-octylphenylthio, 2-pivaloylaminophenylthio, or tetrazolylthio, or an azolyl group such as 1-pyrazolyl, 1-benzotriazolyl, or 5-chloro-1,2,4-triazol-1-yl.

$R_{11}$ and $R_{12}$ may combine with each other to form a ring, preferably a 5-, or 6-membered ring.

Preferable combinations of the substituent groups of the 2-equivalent coupler having the coupling split-off group are those disclosed in JP-A-57-35858 and JP-A-51-20826.

Preferable examples of the 5-pyrazolon magenta coupler will be listed below.

(m-1)

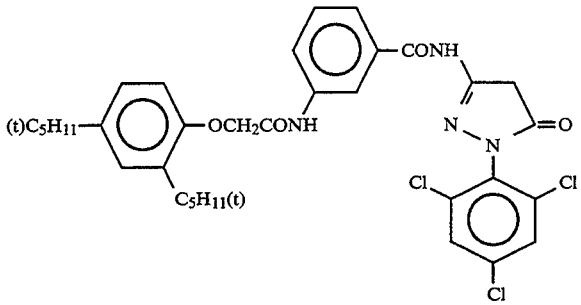

(m-2)

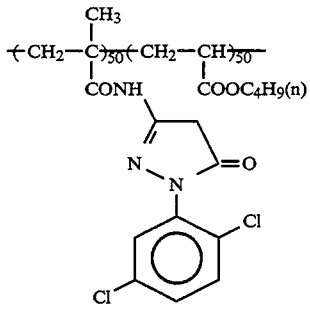

(m-3)

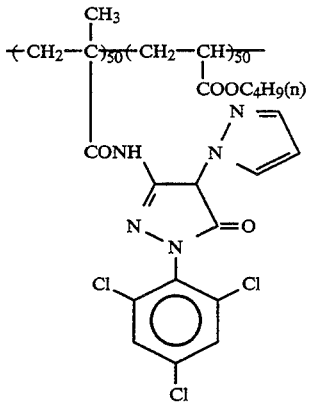

(m-4)

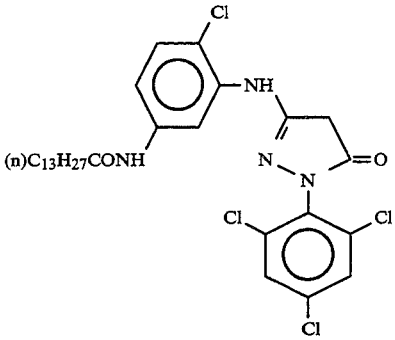

-continued
(m-5)
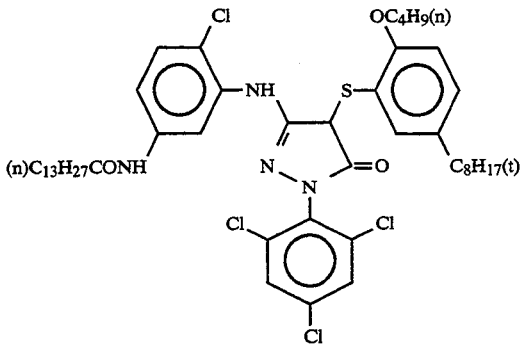
(m-6)
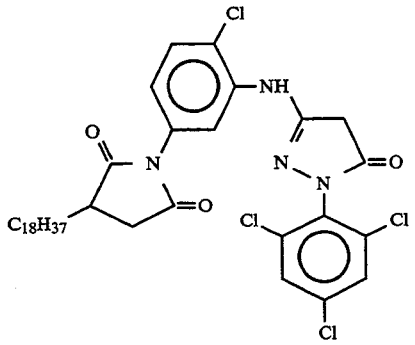
(m-7)
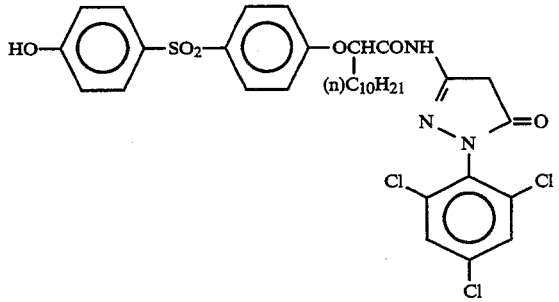
(m-8)
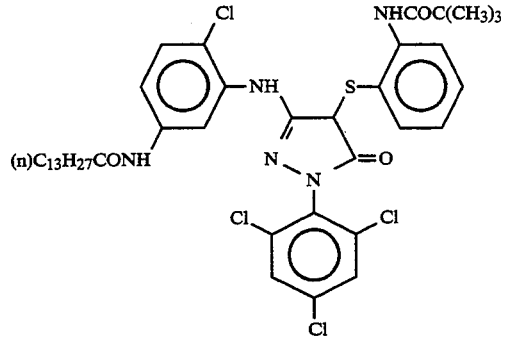
(m-9)
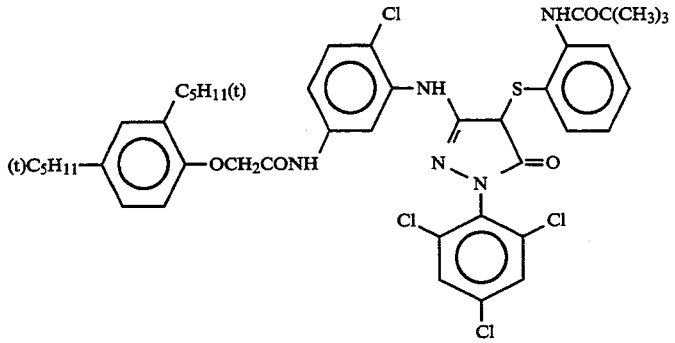

-continued
(m-10)
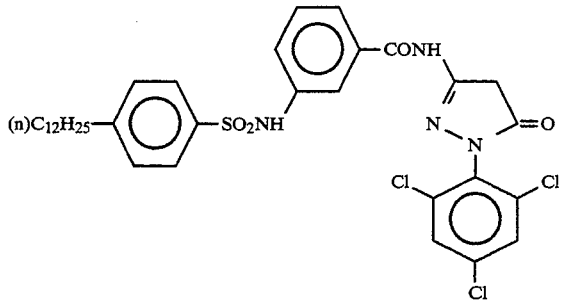
(m-11)
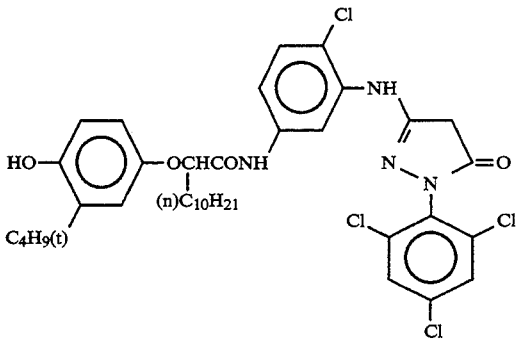
(m-12)
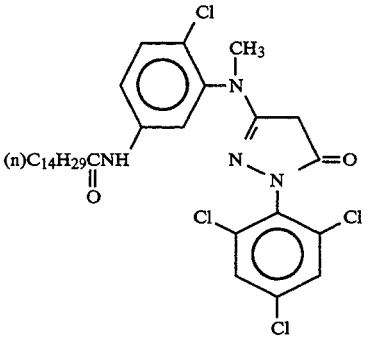
(m-13)
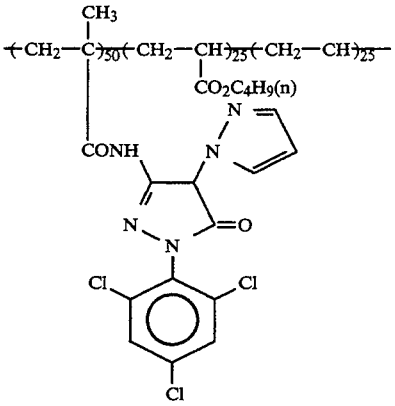

-continued
(m-14)
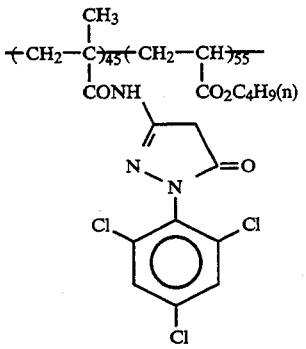
(m-15)
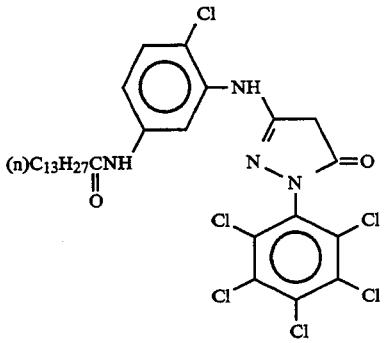
(m-16)
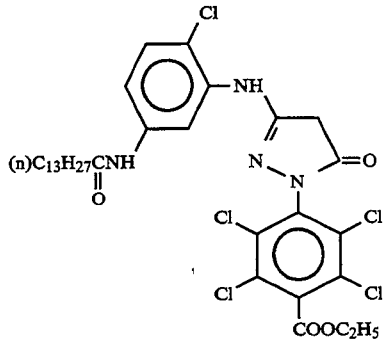
(m-17)
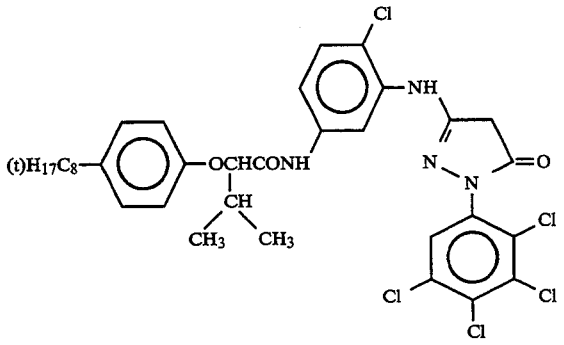

-continued (m-18)

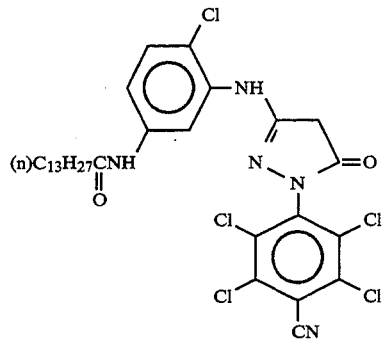

(m-19)

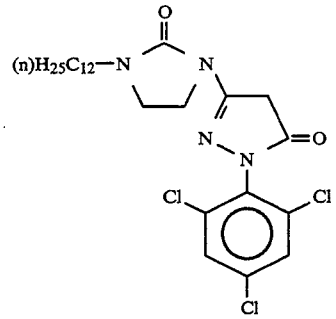

Methods of synthesizing a typical 2-equivalent coupler having a coupling split-off group are disclosed in detail in JP-A-51-20826 and JP-A-57-35858.

A pyrazoloazole magenta coupler can be represented by formula (M):

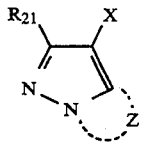

Formula (M)

where $R_{21}$ represents a hydrogen atom, or a substituent; Z represents a non-metallic atomic group required to form a 5-membered azole ring having 2 to 4 nitrogen atoms, wherein the azole ring may contain a substituent, and may include a fused ring; and x represents a hydrogen atom or a group which can be split-off upon a coupling reaction with an oxidized form of a developing agent.

Of the pyrazoloazole couplers represented by formula (M), imidazo[1,2-b]pyrazoles disclosed in U.S. Pat. No. 4,500,630, pyrazolo[1,5-b][1,2,4]triazoles disclosed in U.S. Pat. No. 4,540,654, and pyrazolo[5,1-c][1,2,4]triazoles disclosed in U.S. Pat. No. 3,725,067 are preferable in terms of absorption characteristics of a formed dye, and pyrazolo[1,5-b][1,2,4]triazoles are more preferable also in terms of light fastness.

Details of the substituent group of an azole ring, represented by $R_{21}$, X or Z, are disclosed in U.S. Pat. No. 4,540,654, column 2, line 41 to column 8, line 27. Preferable examples of the coupler are a pyrazoloazole coupler in which a branched alkyl group is directly bonded to 2-, 3- or 6-position of the pyrazolotriazole ring, disclosed in JP-A-61-65245 and JP-B-2-60167; a pyrazoloazole coupler containing a sulfonamido group within the molecule, disclosed in JP-A-61-65246; a pyrazoloazole coupler having a alkoxyphenylsulfonamido ballast group, disclosed in JP-A-61-147254; a pyrazolotriazole coupler having an alkoxy group or an aryloxy group at 6-position, disclosed in JP-A-62-209457 or JP-A-63-307453; a pyrazolotriazole coupler having a phenylene group at 2-position, disclosed in JP-A-63-41851; and a pyrazolotriazole coupler having a carbonamido group within the molecule, disclosed in JP-1-22279.

Of the couplers, specific examples of the pyrazolotriazole coupler will be listed below.

| compound | $R_{21}$ | $R_{22}$ | X |
|---|---|---|---|
| | | 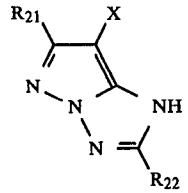 | |
| M-1 | $CH_3$— | 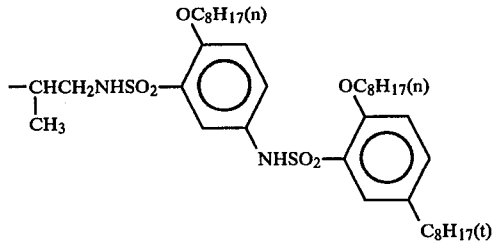 | Cl |
| M-2 | $CH_3$— | 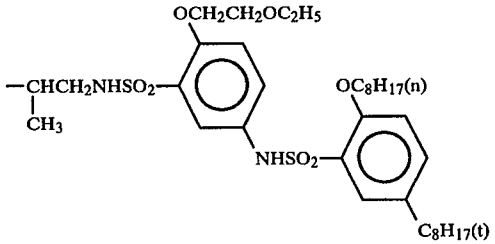 | Cl |
| M-3 | " | 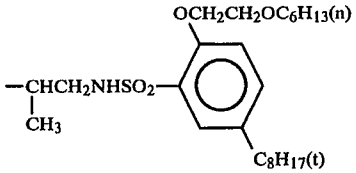 | " |
| M-4 | " | 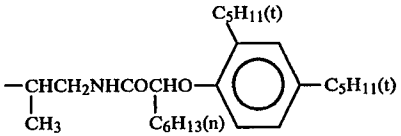 | " |

-continued
| compound | $R_{21}$ | $R_{22}$ | X |
|---|---|---|---|
| M-5 | " | 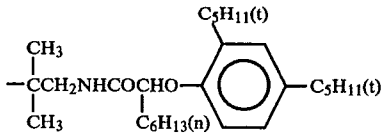 | " |
| M-6 | 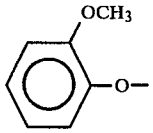 | 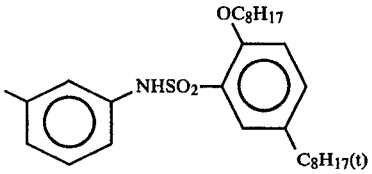 | 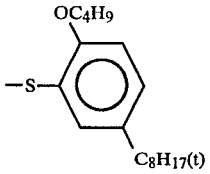 |
| M-7 | " | 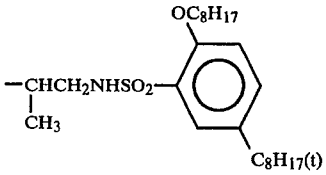 | Cl |
| M-8 | 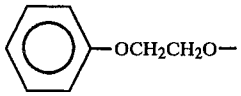 | 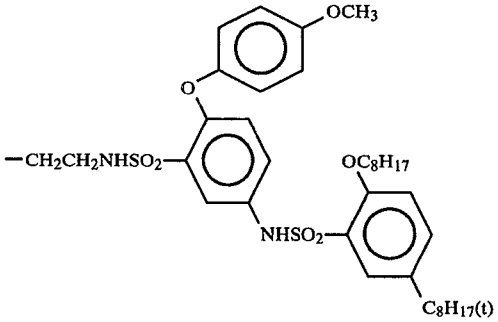 | " |
| M-9 | 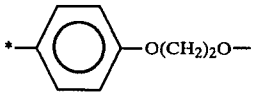 | 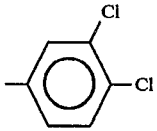 | 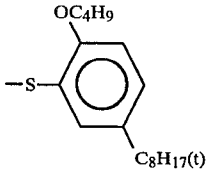 |

-continued
| compound | $R_{21}$ | $R_{22}$ | X |
|---|---|---|---|
| | 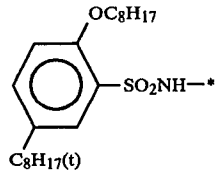 | | |
| M-10 | 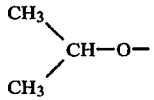 | 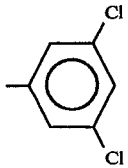 | " |
| M-11 | $C_2H_5$— | 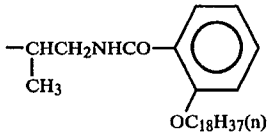 | 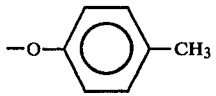 |
| M-12 | $CH_3$— | 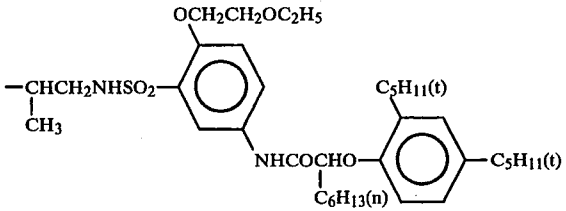 | Cl |
| M-13 | 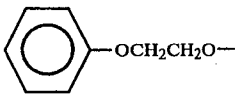 | 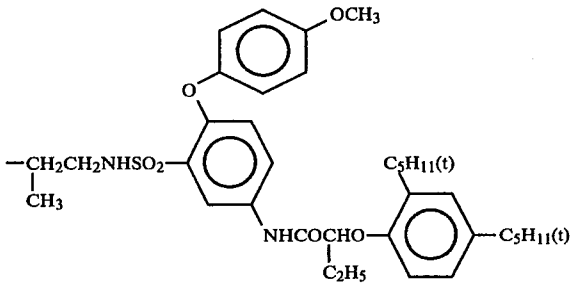 | 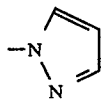 |

-continued
| compound | $R_{21}$ | $R_{22}$ | X |
|---|---|---|---|
| M-14 | " | 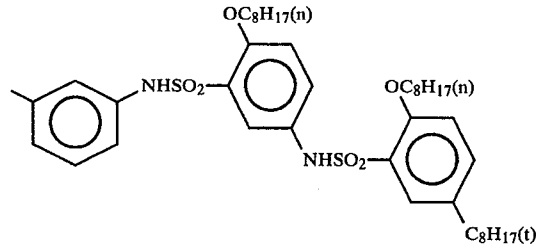 | 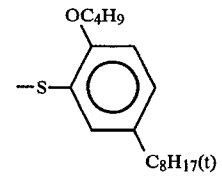 |
| M-15 | 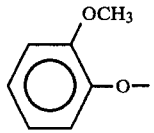 | 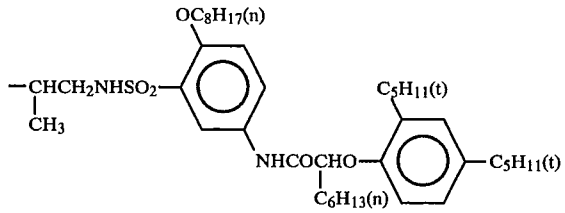 | Cl |
| M-16 | " | " | 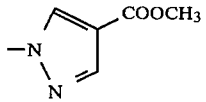 |
| M-17 | 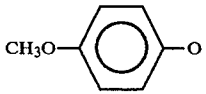 | 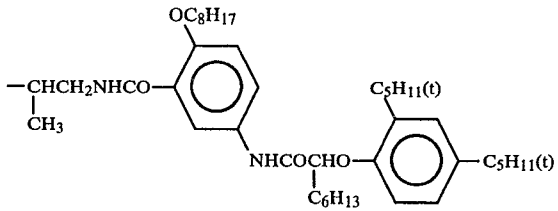 | 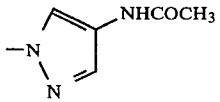 |
| M-18 | " | 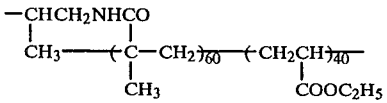 | 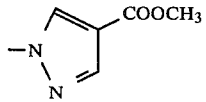 |

-continued
| compound | $R_{21}$ | $R_{22}$ | X |
|---|---|---|---|
| M-19 | 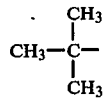 | 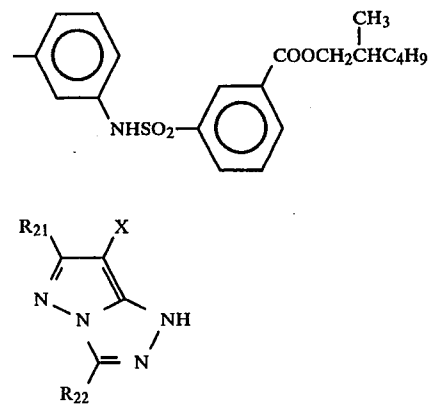 | Cl |
| M-20 | $CH_3$ | 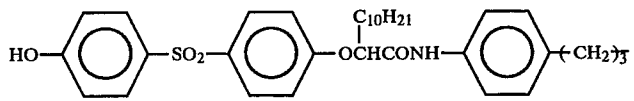 | Cl |
| M-21 | " | 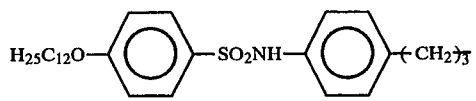 | " |
| M-22 | " | 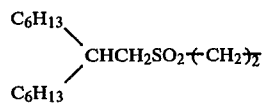 | " |
| M-23 | 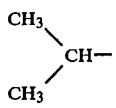 | 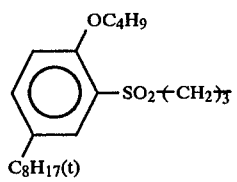 | Cl |

-continued
| compound | $R_{21}$ | $R_{22}$ | X |
|---|---|---|---|
| M-24 | $CH_3$— | 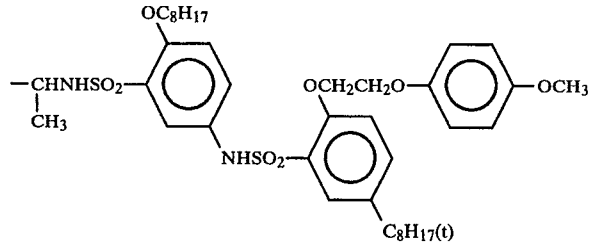 | " |
| M-25 | $C_2H_5$— | 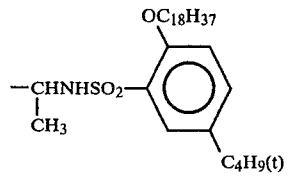 | 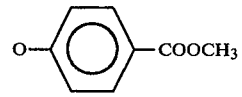 |
| M-26 | $C_2H_5$— | 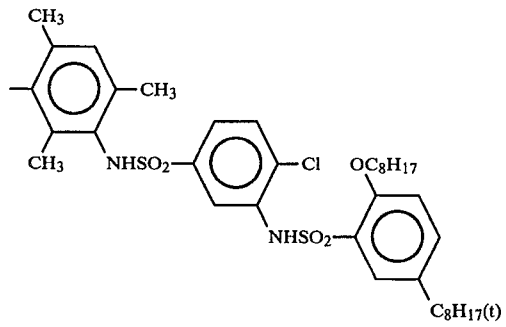 | 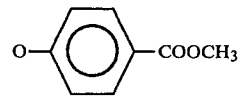 |
| M-27 | $CH_3$— | 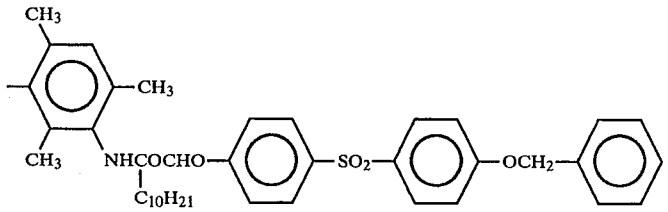 | Cl |

-continued
| compound | $R_{21}$ | $R_{22}$ | X |
|---|---|---|---|
| M-28 | " | 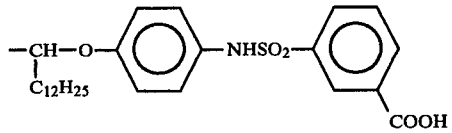 | " |
| M-29 | $CH_3$— | 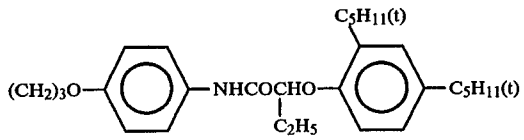 | Cl |
| M-30 | $C_2H_5$— | 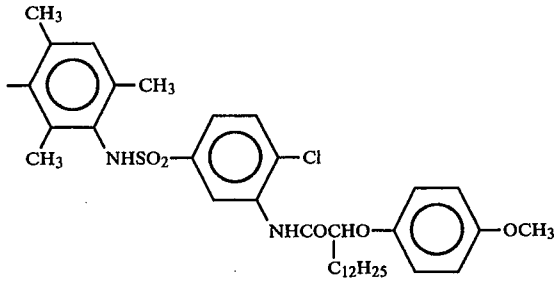 | 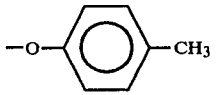 |
| M-31 | 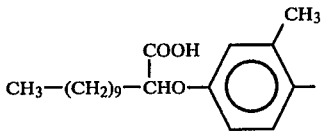 | 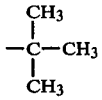 | Cl |
| M-32 | 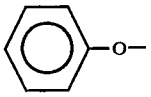 | 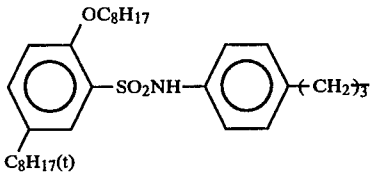 | Cl |

-continued
| compound | $R_{21}$ | $R_{22}$ | X |
|---|---|---|---|
| M-33 | 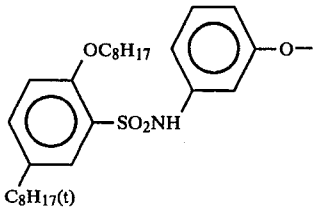 | $H_5C_2$— | " |
| M-34 | 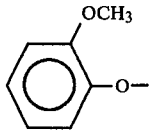 | $H_5C_2OOC$— | 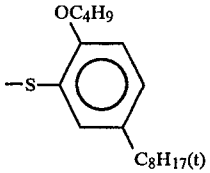 |
| M-35 | 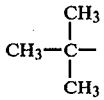 | 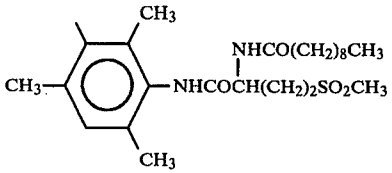 | Cl |
| M-36 | 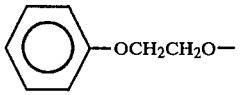 | 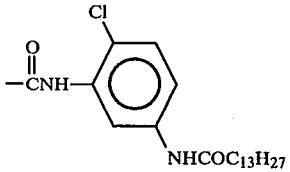 | 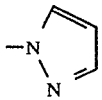 |

The couplers represented by formula (M) can be synthesized by methods disclosed in U.S. Pat. Nos. 4,540,654, 4,705,863, JP-A-61-65245, JP-A-62-209457, JP-A-62P249155, JP-B-47-27411, U.S. Pat. No. 3,725,067, and the like.

In the present invention, the ratio of the magenta coupler to the cyan coupler in the highest sensitivity layer of the red-sensitive emulsion layers is preferably 5 mole % to 100 mole %, more preferably 7 mole % to 80 mole%. Further, the ratio of the magenta coupler to the cyan coupler in a red-sensitive silver halide emulsion layer having a lower sensitivity is preferably 2 mole % to 50 mole %, more preferably 4 mole % to 40 mole %.

The amount of the magenta coupler in the highest sensitivity red-sensitive emulsion layer is preferably $5.0\times10^{-3}$ to $2.0\times10^{-1}$ g/m$^2$, more preferably $1.0\times10^{-2}$ to $1.0\times10^{-1}$ g/m$^2$. The amount of the cyan coupler in the layer is preferably $1.0\times10^{-2}$ to 1.0 g/m$^2$.

Further, the amount of the magenta colored cyan coupler in each lower sensitivity red-sensitive layer is $5.0\times10^{-3}$ to $5.0\times10^{-1}$ g/m$^2$, more preferably $1.0\times10^{-2}$ to $3.0\times10^{-1}$ g/m$^2$. The amount of the cyan coupler in the layer is not particularly limited, but is preferably $1.0\times10^{-2}$ to 2.0 g/m$^2$.

In the case where there are 3 or more red-sensitive emulsion layers, it is sufficient that the highest sensitivity red-sensitive layer contain a cyan coupler and a magenta coupler, and that any one of less sensitive layers contains a cyan coupler and a magenta colored cyan coupler, in which, preferably, a lower sensitivity layer has a higher ratio of the magenta colored cyan coupler to the cyan coupler.

Preferably, a red-sensitive emulsion layer having a lower sensitivity contains at least one compound (DIR compound) which releases a development inhibitor or a precursor thereof, upon reacting with an oxidized form of a developing agent used in the invention, or which cleaves to form another compound after reacting with an oxidized form of a developing agent, which cleaved compound in turn reacts with another molecule of the oxidized form of a developing agent to release a development inhibitor. These compounds can be preferably represented by the following formula (XI) or (XII).

$$A\text{-}(TIME)_a\text{-}DI \qquad \text{Formula (XI)}$$

$$A\text{-}(TIME)_i\text{-}RED\text{-}DI \qquad \text{Formula (XII)}$$

where A represents a group which splits off $(TIME)_a$-DI or $(TIME)_i$-RED-DI upon reaction (e.g., coupling reaction, or redox reaction) with an oxidized form of an aromatic primary amine color developing agent; TIME represents a timing group which cleaves DI or RED-DI after released from A; RED represents a group which cleaves DI by reacting with an oxidized form of a developing agent after released from A or TIME; DI represents a development inhibitor; a is 0, 1, or 2, and i is 0 or 1, and when a is two, two TIMEs may be the same or different.

When A represents a yellow dye-forming coupler moiety, examples of the coupler moiety are pivaloylacetoanilide-type, benzoylacetoanilide-type, malonester-type, malonamide-type, malonestermonoamide-type benzoimidazolylacetoamide-type, and cycloalkanoylacetoamide-type coupler moieties. Further, the coupler moiety may be of the type disclosed in U.S. Pat. Nos. 5,021,332, or 5,021,330, or British Patent 421221A.

When A represents a magenta dye-forming coupler moiety, examples of the coupler moiety are 5-pyrazolone-type, pyrazolobenzimidazole-type, pyrazolotriazole-type, pyrazoloimidazole-type, and cyanoacetophenone-type coupler moieties.

When A represents a cyan color dye-forming coupler moiety, examples thereof are phenol-type and naphthol-type coupler moieties. Further, the coupler moiety may be of the type disclosed in U.S. Pat. No. 4,746,602, or European Patent 249453A.

Further, a coupler moiety represented by A may a coupler moiety which does not substantially form a dye. Examples of the non-dye-forming coupler moiety are indanone-type and acetophenone-type coupler moieties, and the dissolving-out type coupler moiety disclosed in European Patent 443530A or 444501A.

When A represents a redox group, the group is one which can be oxidized by an oxidizing substance present during development, for example, an oxidized form of a developing agent. Examples of the group are of hydroquinone-type, catechol-type, pyrogallol-type, 1,4 (or 1,2)-naphthohydroquinone-type, sulfonamidophenol-type hydrazide-type and sulfonamidonaphthol-type. Specific examples of these groups are disclosed in JP-A-61-230135, JP-A-62-251746, JP-A-61-278852, U.S. Pat. Nos. 3,364,022, 3,379,529, 4,618,571, 3,639,417 and 4,684,604, and *J. Org. Chem.*, vol.29, page 588 (1964).

In formula (XI) or (XII), preferable examples of A are coupler moieties represented by the following formulas (Cp-1), (Cp-2), (Cp-3), (Cp-4), (Cp-5), (Cp-6), (Cp-7), (Cp-8), (Cp-9), and (Cp-10). These types of couplers are preferable because of their high coupling rates.

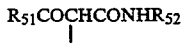

Farmula (Cp-1)

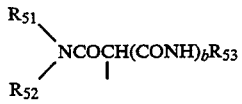

Farmula (Cp-2)

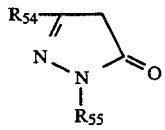

Farmula (Cp-3)

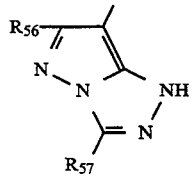

Farmula (Cp-4)

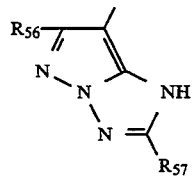

Farmula (Cp-5)

-continued

Farmula (Cp-6)

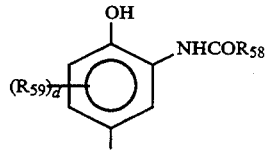

Farmula (Cp-7)

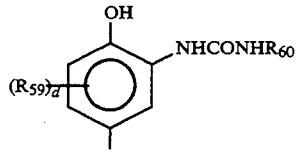

Farmula (Cp-8)

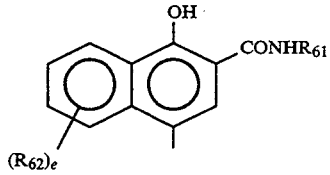

Farmula (Cp-9)

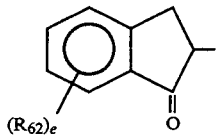

Farmula (Cp-10)

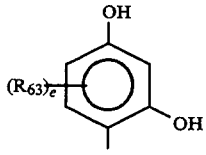

A free bond derived from the coupling position in the above formulas is a bonding position of a coupling split-off group.

In the above formulas, when $R_{51}$, $R_{52}$,$R_{53}$, $R_{54}$, $R_{55}$, $R_{56}$, $R_{57}$, $R_{58}$, $R_{59}$, $R_{60}$, $R_{61}$, $R_{62}$, or $R_{63}$ contains a non-diffusing group, they have 8 to 40 carbon atoms, preferably 10 to 30 carbon atoms, otherwise the total number of carbon atom is preferably 15 or less. In the case of the bis-type, telomer-type, or polymer-type coupler, any of the above substituent is a divalent group, which links the repeating units or the like. In this case, the number of carbon atoms may be out of the set range.

The substituent groups $R_{51}$–$R_{63}$, and b, d and e will be described in detail. In the following description, $R_{41}$ represents an alkyl group, an aryl group or a heterocyclic group, $R_{42}$ represents an aryl group or a heterocyclic group, each of $R_{43}$, $R_{44}$, and $R_{45}$ represents a hydrogen atom, an alkyl group, an aryl group or a heterocyclic group. $R_{51}$ has the same meaning as $R_{41}$. Each of $R_{52}$ and $R_{53}$ has the same meaning as $R_{43}$. b is 0 or 1. $R_{54}$ represents a group of the same meaning as $R_{41}$, $R_{41}CO(R_{43})N$— group, $R_{41}SO_2(R_{43})N$— group, $(R_{43})N$-group, $R_{41}(R_{43})N$— group, $R_{41}S$— group, or $R_{45}(R_{43})NCON(R_{44})N$— group.

$R_{55}$ is a group of the same meaning as $R_{41}$. Each of $R_{56}$ and $R_{57}$ represents a group of the same meaning as $R_{43}$, or $R_{41}S$— group, $R_{43}O$— group, $R_{41}CO(R_{43})N$— group, or $R_{41}SO_2(R_{43})N$— group. $R_{58}$ is a group of the same meaning as $R_{41}$. $R_{59}$ is a group of the same meaning as $R_{41}$, $R_{41}CO(R_{43})N$— group, $R_{41}OCO(R_{43})N$— group, $R_{41}SO_2(R_{43})N$— group, $R_{43}(R_{44})NCO(R_{45})N$— group, $R_{41}O$— group, $R_{41}S$— group, a halogen atom, or $R_{41}(R_{43})N$— group. d is an integer of 0–3. When d is two or more, a plurality of $R_{59}$ groups may be the same or different. $R_{60}$ is a group of the same meaning as $R_{41}$. $R_{61}$ is a group of the same meaning as $R_{41}$. $R_{62}$ is a group of the same meaning as $R_{41}$, or $R_{41}CONH$— group, $R_{410}CONH$— group, $R_{41}SO_2NH$— group, $R_{43}(R_{44})NCONH$— group, $R_{43}(R_{44})NSO_2NH$— group, $R_{43}0$— group, $R_{41}S$— group, a halogen atom, or $R_{41}NH$— group. $R_{63}$ is a group of the same meaning as $R_{41}$, or $R_{43}CO(R_{44})N$— group, $R_{43}(R_{44})NCO$— group, $R_{41}SO_2(R_{43})N$— group, $R_{41}(R_{43})NSO_2$— group, $R_{41}SO_2$— group, $R_{43}OCO$— group, a halogen atom, a nitro group, a cyano group, or $R_{43}CO$— group. e is an integer of 0 to 4. When there are a plural number of $R_{62}$ or $R_{63}$ they may be the same or different.

In the above description, an alkyl group is a saturated or unsaturated, chain or cyclic, straight or branched, or substituted or unsubstituted alkyl group having 1 to 32, preferably 1 to 22, carbon atoms. Typical examples are methyl, cyclopropyl, isopropyl, n-butyl, t-butyl, i-butyl, t-amyl, cyclohexyl, 2-ethylhexyl, 1,1,3,3-tetramethylbutyl, n-dodecyl, n-hexadecyl, and n-octadecyl.

An aryl group has 6 to 20 carbon atoms, and is preferably a substituted or unsubstituted phenyl, or a substituted or unsubstituted naphthyl.

A heterocyclic group is a substituted or unsubstituted, preferably 3- to 8-membered, hetrocyclic group having 1 to 20, preferably 1 to 7 carbon atoms, and containing a heteroatom selected from nitrogen, oxygen and sulfur atoms. Typical examples of the heterocyclic group are 2-imidazolyl, 2-benzimidazolyl, morpholino, pyrrolidino, 1,2,4-triazol-2-yl, or 1-indolynyl.

When the above-listed alkyl group, aryl group, or heterocyclic group has a substituent, typical examples of the substituent are a halogen atom, $R_{47}O$— group, $R_{46}S$— group, $R_{47}CO(R_{48})N$— group, $R_{47}(R_{48})NCO$— group, $R_{46}SO_2(R_{47})N$— group, $R_{47}(R_{48})NSO_2$— group, $R_{46}SO_2$— group, $R_{47}OCO$— group, $R_{47}CONHSO_2$— group, $R_{47}(R_{48})NCONHSO_2$— group, a group of the same meaning as $R_{46}$, $R_{47}(R_{48})N$— group, $R_{46}CO$— group, a cyano group and a nitro group. $R_{46}$ represents an alkyl group, an aryl group, or a heterocyclic group, and each of $R_{47}$ and $R_{48}$ represents an alkyl group, an aryl group, a heterocyclic group, or a hydrogen atom. Each of the alkyl group, aryl group, and heterocyclic group has the same meaning defined before.

The development inhibitor represented by DI will now be described.

Examples of the development inhibitor represented by DI are those disclosed in U.S. Pat. Nos. 4,477,563, 5,021,332, 5,026,628, 3,384,657, 3,615,506, 3,617,291, 3,733,201, 3,933,500, 3,958,993, 3,961,959, 4,149,886, 4,259,437, 4,095,984 and 4,782,012, British Patent 1,450,479, and U.S. Pat. No. 5,034,311. Preferable examples are tetrazolylthio, 1,3,4-oxadiazolylthio, 1,3,4-thiazoazolylthio, 1-(or 2-)benzotriazolyl, 1,2,4-triazol-1-(or 4-)yl, 1,2,3-triazol-1-yl, 2-benzothiazolylthio, 2-benzimidazolylthio, and derivatives thereof. Typical development inhibitors are as follows. In the following formulas, "}" means that the substituent bonds to the 5- or 6-position of the benzotriazole.

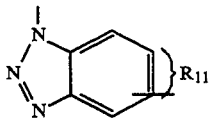

| $R_{11}$ D-No. | $-CO_2CH_2CO_2H_5H_{11}(i)$ (D-1) | $-CO_2CH_2CO_2C_4H_9$ (D-2) | $-CO_2C_6H_5$ (D-3) |
|---|---|---|---|

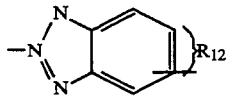

| $R_{12}$ D-No. | $-CO_2CH_2CO_2C_5H_{11}(i)$ (D-4) | $-CO_2CH_2CO_2C_4H_9$ (D-5) | $-CO_2C_6H_5$ (D-6) |
|---|---|---|---|

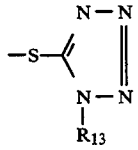

| $R_{13}$ D-No. | $-C_2H_5$ (D-7) | $-C_4H_9-$ (D-8) | $-C_4H_9(t)$ (D-9) | $-C_6H_5$ (D-10) |
|---|---|---|---|---|

$-CH_2CO_2C_4H_9$ (D-11) $-CH_2CO_2C_3H_7$ (D-12)

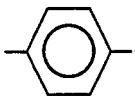

(D-13)

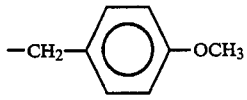

(D-14)

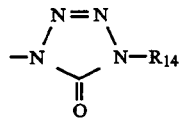

| $R_{14}$ D-No. | $-C_4H_9$ (D-15) | $-CH_2CO_2C_4H_9$ (D-16) | $-C_6H_5$ (D-17) |
|---|---|---|---|

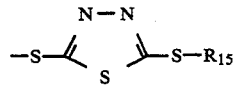

| $R_{15}$ D-No. | $-CH_3$ (D-18) | $-CH_2CO_2C_2H_5$ (D-19) | $-CH(CH_3)CO_2CH_3$ (D-20) |
|---|---|---|---|

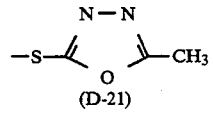

(D-21)

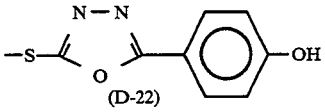

(D-22)

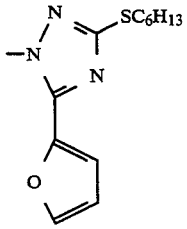

(D-23)

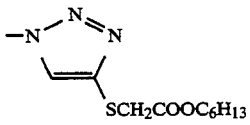

(D-24)

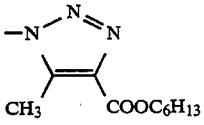

(D-25)

The group represented by TIME will now be described.

The group represented by TIME can be any linking group which can cleave DI or RED-DI after being cleaved from A during a development process. Examples thereof are groups utilizing the cleaving reaction of hemiacetal, disclosed in U.S. Pat. Nos. 4,146,396, 4,652,516, and 4,698,297; timing groups causing a cleaving reaction by utilizing an intramolecular nucleophilic substitution reaction, disclosed in U.S. Pat. Nos. 4,248,962, 4,847,185, and 4,857,440; timing groups causing a cleaving reaction by utilizing an electron transfer reaction, disclosed in U.S. Pat. Nos. 4,409,323, and 4,421,845; groups causing a cleaving reaction by utilizing a hydrolysis reaction of iminoketal, disclosed in U.S. Pat. No. 4,546,073; and groups causing a cleaving reaction by utilizing a hydrolysis reaction of ester, disclosed in West German Patent 2626317. TIME is bonded to A at a heteroatom, preferably an oxygen atom, a sulfur atom, or a nitrogen atom, contained in TIME. Preferable groups represented by TIME are those expressed by the following formulas (T-1), (T-2), and (T-3).

$*-W-(X{=}Y)j-C(R_{122})R_{121}-**$ Formula (T-2)

$*-W-CO-**$ Formula (T-2)

$*-W-LINK-E-**$ Formula (T-3)

where * represents the position at which the group is bonded to A in formula (II), ** represents the position at which the group is bonded to DI or TIME (when a is plural), W represents an oxygen atom, a sulfur atom, or $>N-R_{123}$, each of X and Y represents a methyne or nitrogen atom, j is 0, 1, or 2, and each of $R_{121}$, $R_{122}$, and $R_{123}$ represents a hydrogen atom or a substituent. When each of X and Y represent a substituted methyne group, any two of substituents $R_{121}$, $R_{122}$, and $R_{123}$ may or may not combine together to form a cyclic structure (for example, a benzene ring, and a pyrazole ring). In the formula (T-3), E represents an electrophilic group, and LINK represents a linking group which sterically connects W and E such that they may undergo an intramolecular nucleophilic substitution reaction.

Typical examples of TIME are as follows:

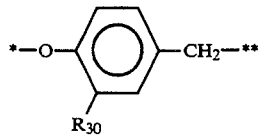

| $R_{30}$ | $-NO_2$ | $-NHSO_2CH_3$ | H | $-NHSO_2C_{16}H_{33}$ |
|---|---|---|---|---|
| TI-No. | (TI-1) | (TI-2) | (TI-3) | (TI-4) |

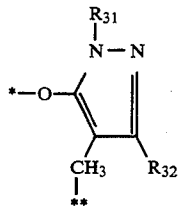

| $R_{31}$ | 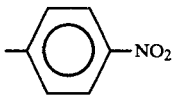 | 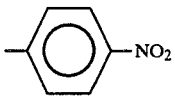 | 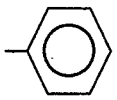 |
|---|---|---|---|
| $R_{32}$ | $-CH_3$ | $-C_{11}H_{23}$ | $-CH_3$ |
| TI-No. | (TI-5) | (TI-6) | (TI-7) |

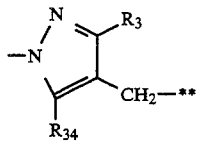

| $R_{33}$ | $-CH_3$ | $-CH_3$ | $-C_2H_5$ |
|---|---|---|---|
| $R_{34}$ | $-CH_3$ | $-H$ | $-H$ |
| TI-No. | (TI-8) | (TI-9) | (TI-10) |

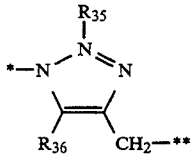

| $R_{35}$ | $-CH_3$ | $-H$ | $-H$ |
|---|---|---|---|
| $R_{36}$ | $-H$ | $-H$ | $-CH_3$ |
| TI-No. | (TI-11) | (TI-12) | (TI-13) |

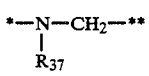

| $R_{37}$ | $-CH(CH_3)_2$ | $-CH_2CO_2CH_3$ | $-C_{16}H_{31}$ | $-CH_2CO_2C_2H_5$ |
|---|---|---|---|---|
| TI-No. | (TI-14) | (TI-15) | (TI-16) | (TI-17) |

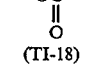

(TI-18)

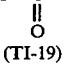

(TI-19)

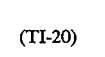

(TI-20)

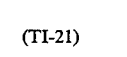

(TI-21)

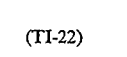

(TI-22)

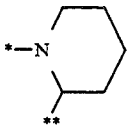

(TI-23)

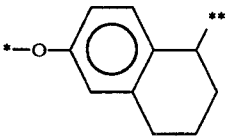

(TI-40)

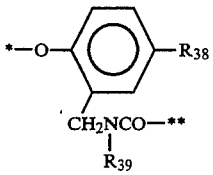

| $R_{38}$ | $-NO_2$ | $-NO_2$ | $NO_2$ | $-OCH$ |
|---|---|---|---|---|
| $R_{39}$ | $-CH_2H_5$ | $-C_3H_7(i)$ | $-CH_3$ | $-CH_3$ |
| TI-No. | (TI-25) | (TI-26) | (TI-27) | (TI-28) |

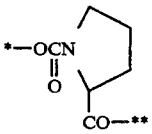

(TI-29)

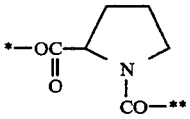

(TI-30)

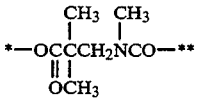

(TI-31)

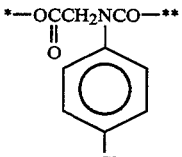

(TI-32)

-continued

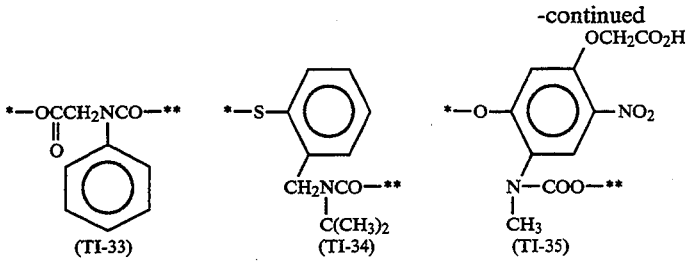

The group represented by RED in formula (XII) will be described.

RED-DI may be any group which cleaves DI when oxidized by a oxidizing material present during a developing process, for example, an oxidized form of a developing agent. Examples of RED are hydroquinones, catechols, pyrogallols, 1,4-naphthohydroquinones, 1,2-naphthohydroquinones, sufonamidophenols, hydrazides, and sulfonamidonaphthol group. Specific examples are the same as those listed in the prior art documents above for the case where A represents a redox group.

Preferable examples of RED are a hydroquinone, a 2(or 4)-sulfonamidophenol, and a pyrogallol. Each of these groups is bonded to A at the oxygen atom of the phenolic hydroxy group.

Typical examples of the DIR compound used in the present invention will be listed, but the invention is not limited to these examples.

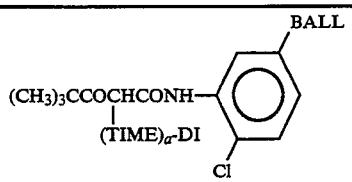

| Cp-No. | a | TIME | DI | BALL |
|---|---|---|---|---|
| (1) | 0 | not present | (D-3) | 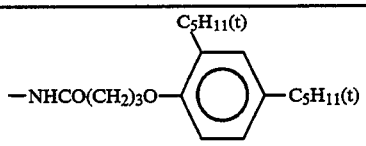 |
| (2) | 0 | not present | (D-1) | " |
| (3) | 1 | (TI-25) | (D-12) | —NHSO2C16H33 |
| (4) | 1 | (TI-25) | (D-14) | " |
| (5) | 1 | (TI-25) | (D-11) | " |
| (6) | 2 | (TI-35) | (TI-3), (D-19) | —NHSO2C16H33 |
| (7) | 1 | (TI-7) | (D-19) | —NHSO2C12H25 |

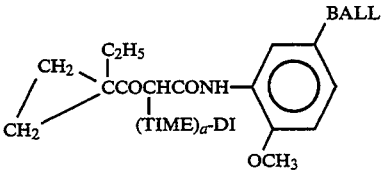

| | | | | |
|---|---|---|---|---|
| (8) | 0 | not present | (D-1) | —NHSO2C16H33 |
| (9) | 1 | (TI-8) | (D-12) | —COOC12H25 |

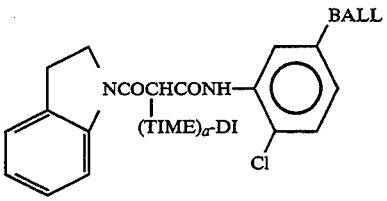

| | | | | |
|---|---|---|---|---|
| (10) | 0 | not present | (D-1) | —SO2NHCOC13H27 |
| (11) | 0 | not present | (D-1) | —SO2NHCONHC16H33 |
| (12) | 0 | not present | (D-1) | 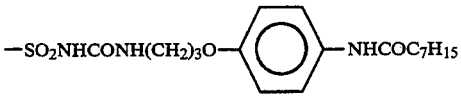 |

-continued
| | | | | |
|---|---|---|---|---|
| (13) | 0 | not present | (D-3) | 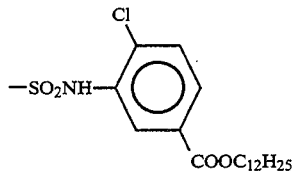 |
| (14) | 1 | (TI-1) | (D-12) | $-CONHSO_2C_{16}H_{33}$ |
| (15) | 0 | not present | (D-1) | 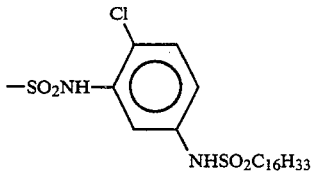 |
| (16) | 1 | (TI-25) | (D-12) | 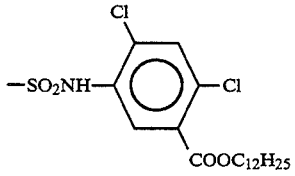 |
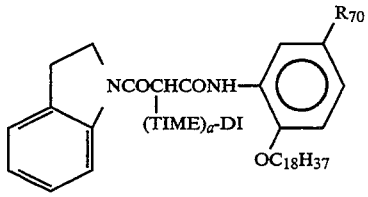
| Cp-No. | a | TIME | DI | $R_{70}$ |
|---|---|---|---|---|
| (17) | 0 | not present | (D-1) | 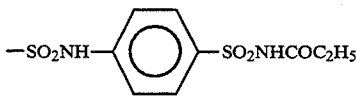 |
| (18) | 1 | (TI-1) | (D-12) | " |
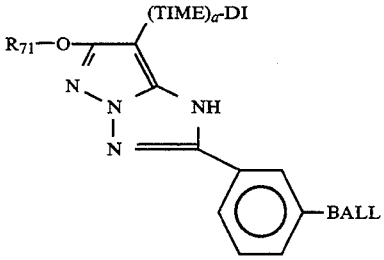
| Cp-No. | a | TIME | DI | $R_{71}$ | BALL |
|---|---|---|---|---|---|
| (19) | 0 | not present | (D-1) | 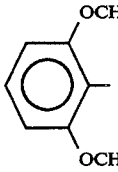 | 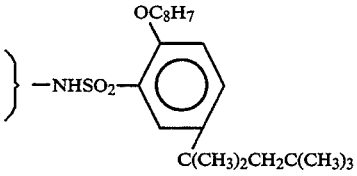 |
| (20) | 0 | not present | (D-2) | | |
| (21) | 0 | not present | (D-4) | | |

-continued
| | | | | |
|---|---|---|---|---|
| (22) | 1 | (TI-1) | (D-18) | 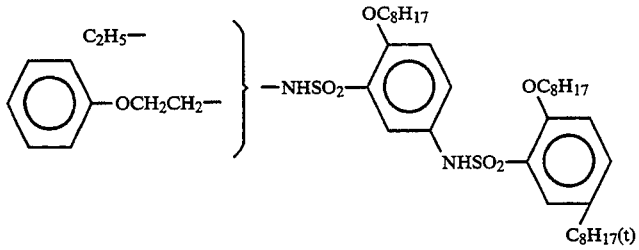 |
| (23) | 0 | not present | (D-25) | |
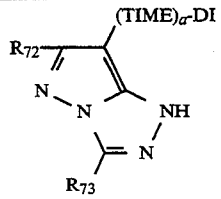
| Cp-No. | a | TIME | DI | $R_{72}$ | $R_{73}$ |
|---|---|---|---|---|---|
| (24) | 0 | not present | (D-1) | $CH_3$— | 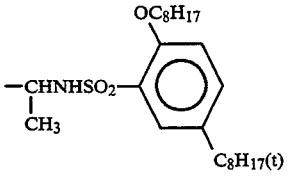 |
| (25) | 0 | not present | (D-2) | $(CH_3)_2CH$— | |
| (26) | 0 | not present | (D-1) | $C_2H_5$— | 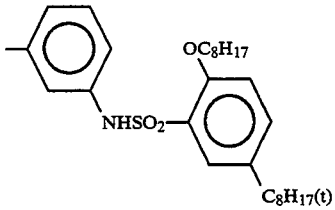 |
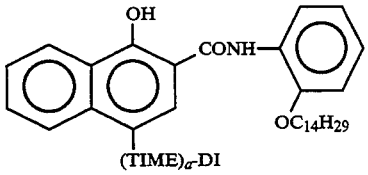
| Cp-No. | a | TIME | DI |
|---|---|---|---|
| (27) | 2 | (TI-18)-(TI-15) | (D-15) |
| (28) | 1 | (TI-21) | (D-3) |
| (29) | 1 | (TI-1) | (D-10) |
| (30) | 1 | (TI-1) | (D-14) |
| (31) | 1 | (TI-1) | (D-9) |
| (32) | 2 | (TI-18)-(TI-8) | (D-8) |
| (33) | 2 | (TI-34)-(TI-1) | (D-10) |
| (34) | 2 | (TI-18)-(TI-17) | (D-16) |
| (35) | 2 | (TI-18)-(TI-15) | (D-16) |
| (36) | 2 | (TI-18)-(TI-14) | (D-20) |
| (37) | 1 | (TI-5) | (D-13) |
| (38) | 1 | (TI-5) | (D-21) |
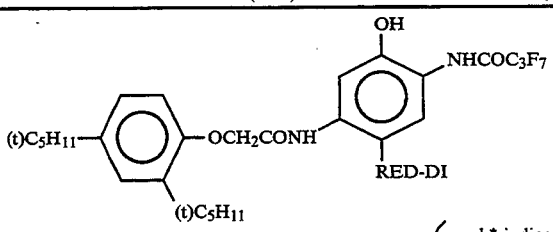
(mark* indicates bonding position with the coupler)

-continued
| Cp-No. | RED | DI |
|---|---|---|
| (39) | 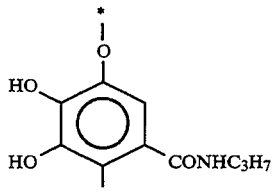 | (D-20) |
| (40) | 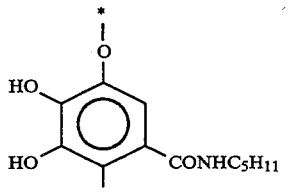 | (D-20) |
| (41) | 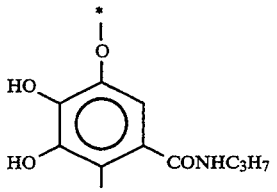 | (D-10) |
| (42) | 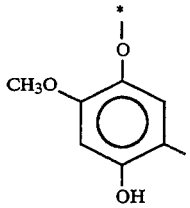 | (D-7) |
| (43) | 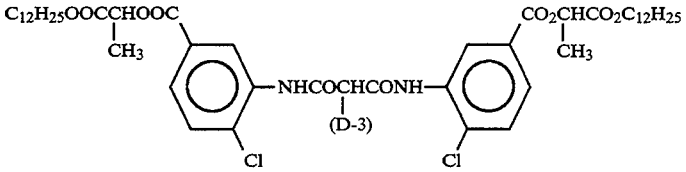 | |
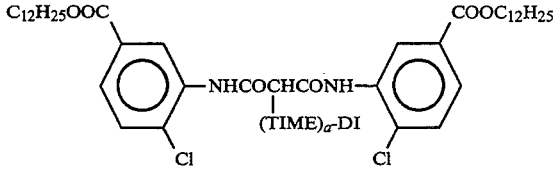
| Cp-No. | a | TIME | DI |
|---|---|---|---|
| (44) | 0 | not present | (D-1) |
| (45) | 0 | not present | (D-3) |
| (46) | 0 | not present | (D-24) |
| (47) | 1 | (TI-12) | (D-9) |
(48)
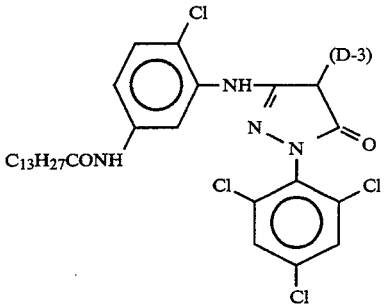

-continued (49)

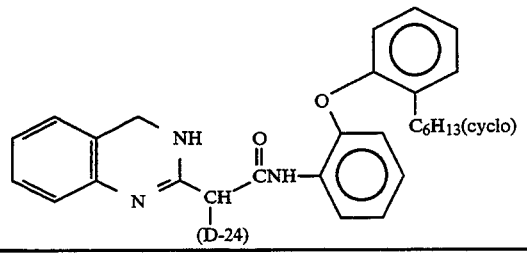

(D-24)

The techniques, and the inorganic and organic materials which can be used in the color photographic light-sensitive material of the invention are disclosed in the below-listed sections of European Patent 36,938A2, and the specified patents.

1. Layer structure: page 146, line 34—page 147, line 25
2. Silver halide emulsion: page 147, line 26—page 148, line 12
3. Yellow coupler: page 137, line 35—146, line 33, and page 149, lines 21–23
4. Magenta coupler: page 149, lines 24–28; European Patent No. 421,453Al, page 3, line 5—page 25, line 55
5. Cyan coupler: page 149, lines 29–33, European Patent No. 432,804A2, page 3, line 28—page 40, line 2
6. Polymer coupler: page 149, lines 34–38; European Patent. No. 435,334A2, page 113, line 39—page 123, line 7
7. Colored coupler: page 53, line 42—page 137, line 34, and page 149, lines 39–45
8. Other functional couplers: page 7, line 1—page 53, line 41, and page 149, line 46—page 150, line 30; European Patent No. 435,334A2, page 3, line 1—page 29, line 50
9. Antiseptics and mildewcides: page 150, lines 25–28
10. Formalin scavenger: page 149, lines 15–17
11. Other additives: page 153, lines 38–47; European Patent. No. 421,453A1, page 75, line 21—page 84, line 56, page 27, line 40—page 37, line 40
12. Dispersion method: page 150, lines 4–24
13. Support: page 150, lines 32–34
14. Film thickness and film properties: page 150, lines 35–49
15. Color developing process: page 150, line 50—page 151, line 47
16. Desilvering step: page 151, line 48—page 152, line 53
17. Automatic developing machine: page 152, line 54—page 153, line 2
18. Water washing and stabilization step: page 153, lines 3–37

EXAMPLES

A multilayered color light-sensitive material constituted by layers having the following compositions was formed on an undercoated triacetylcellulose film support, thereby obtaining a sample 101.

(Compositions of layers)

The coated amounts of silver halide and colloidal silver were expressed by the amount of silver in unit of $g/m^2$, the amounts of couplers, additives, and gelatins were expressed in unit of $g/m^2$, and the amounts of sensitizing dyes were expressed in mole per mole of silver halide in the same layer. The reference symbols indicate the following substances. When a substance exhibits a plurality of effects, the most typical one is cited.

Uv: ultraviolet ray absorber, Solv: High-boiling point organic solvent, ExF: dye, ExS: sensitizing dye, ExC: cyan coupler, ExM: magenta coupler, ExY: yellow coupler, Cpd: additive

| | |
|---|---|
| Layer 1: Antihalation layer | |
| Black colloidal silver | 0.15 |
| Gelantin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| Layer 2 (Low-speed red-sensitive layer) | |
| Silver iodobromide emulsion A | |
| Amount of silver coated | 0.35 |
| Silver iodobromide emulsion B | |
| Amount of silver coated | 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.9 \times 10^{-2}$ |
| ExC-2 | $5.0 \times 10^{-3}$ |
| ExC-5 | $9.5 \times 10^{-2}$ |
| ExC-9 | $2.5 \times 10^{-2}$ |
| Cpd-4 | $2.2 \times 10^{-2}$ |
| Layer 3: (Medium-speed red-sensitive emulsion layer) | |
| Silver iodobromide emulsion C | |
| Amount of silver coated | 0.55 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-4 | $1.6 \times 10^{-2}$ |
| ExC-5 | 0.19 |
| ExC-9 | $3.0 \times 10^{-2}$ |
| Cpd-4 | $1.5 \times 10^{-3}$ |
| Layer 4: (High-speed red-sensitive emulsion layer) | |
| Silver iodobromide emulsion D | |
| Amount of silver coated | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $4.0 \times 10^{-2}$ |
| ExC-4 | $6.0 \times 10^{-2}$ |
| ExC-5 | $5.0 \times 10^{-2}$ |
| ExC-8 | $1.0 \times 10^{-2}$ |
| ExC-9 | $0.7 \times 10^{-2}$ |
| Cpd-4 | $1.0 \times 10^{-3}$ |
| Solv-1 | 0.70 |

-continued

| | |
|---|---|
| Solv-2 | 0.15 |
| Layer 5: (Interlayer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| Layer 6: (Low-speed green-sensitive emulsion | |
| Silver iodobromide emulsion E | |
| Amount of silver coated | 0.10 |
| Silver iodobromide emulsion F | |
| Amount of silver coated | 0.28 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-7 | $2.1 \times 10^{-2}$ |
| Solv-1 | 0.09 |
| Solv-3 | $7.0 \times 10^{-3}$ |
| Layer 7: (Medium-speed green-sensitive emulsion layer) | |
| Silver iodobromide emulsion G | |
| Amount of silver coated | 0.40 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| Layer 8: (High-speed green-sensitive emulsion layer) | |
| Silver iodobromide emulsion H | |
| Amount of silver coated | 0.53 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-2}$ |
| Cpd-6 | $1.0 \times 10^{-2}$ |
| Solv-1 | 0.12 |
| Layer 9: (Interlayer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethylacrylate latex | $5.0 \times 10^{-2}$ |
| Solv-1 | $3.0 \times 10^{-2}$ |
| Layer 10: (Donor layer of an interlayer effect to red-sensitive layer) | |
| Silver iodobromide emulsion I | |
| Amount of silver coated | 0.30 |
| Silver iodobromide emulsion J | |
| Amount of silver coated | 0.20 |
| Silver iodobromide emulsion K | |
| Amount of silver coated | 0.50 |
| Gelatin | 0.87 |
| ExS-3 | $6.7 \times 10^{-4}$ |
| ExM-2 | 0.16 |
| ExM-4 | $3.0 \times 10^{-2}$ |
| ExM-5 | $5.0 \times 10^{-2}$ |
| ExY-2 | $2.5 \times 10^{-3}$ |

-continued

| | |
|---|---|
| ExY-5 | $2.0 \times 10^{-2}$ |
| Solv-1 | 0.30 |
| Solv-5 | $3.0 \times 10^{-2}$ |
| Layer 11: (Yellow Filter Layer) | |
| Yellow colloidal silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| Layer 12: (Low-speed blue-sensitive emulsion layer) | |
| Silver iodobromide emulsion L | |
| Amount of silver coated | 0.40 |
| Silver iodobromide emulsion M | |
| Amount of silver coated | 0.45 |
| Gelatin | 1.75 |
| ExS-6 | $9.0 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-3}$ |
| ExC-2 | $8.0 \times 10^{-2}$ |
| Solv-1 | 0.54 |
| Layer 13: (High-speed blue-sensitive emulsion layer) | |
| Silver iodobromide emulsion N | |
| Amount of silver coated | 0.40 |
| Gelatin | 0.95 |
| ExS-6 | $2.6 \times 10^{-4}$ |
| ExY-2 | $1.0 \times 10^{-2}$ |
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| Layer 14: (First protective layer) | |
| Fine grain silver iodobromide emulsion O | |
| Amount of silver coated | 0.12 |
| Gelatin | 0.63 |
| UV-4 | 0.11 |
| UV-5 | 0.18 |
| Cpd-3 | 0.10 |
| Solv-4 | $2.0 \times 10^{-2}$ |
| Polyethylacrylate latex | $9.0 \times 10^{-2}$ |
| Layer 15: (Second protective layer) | |
| Fine grain silver iodobromide emulsion O | |
| Amount of silver coated | 0.36 |
| Gelatin | 0.85 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-5 | $2.0 \times 10^{-2}$ |
| H-1 | 0.18 |

The sample thus prepared further contained 1,2-benzisothiazolin-3-one (average of 200 ppm with respect to gelatin), n-butyl-p-hydroxybenzoate (about 1000 ppm with respect to gelatin), and 2-phenoxyethanol (about 10000 ppm with respect to gelatin). Each layer contained W-1 to W-6, B-1 to B-6, F-1 to F-16, an iron salt, a lead salt, a gold salt, a platinum salt, an iridium salt, and a rhodium salt, which serve to enhance storage stability, processability, pressure-resistant property, anti-mildew and bacteria property, antistatic property, and coatability, as the case might be.

TABLE 1

| | Average AgI content (mole %) | Average equivalent-sphere diameter (μm) | Variation coefficient of grain distribution (%) | Ratio of diameter/thickness | Silver amount ratio [core/intermediate/shell] (AgI content) | Grain structure and shape |
|---|---|---|---|---|---|---|
| Emulsion A | 5.0 | 0.40 | 10 | 1.0 | [4/1/5] (1/38/1) | triple structure cubic grain |
| Emulsion B | 6.5 | 0.49 | 23 | 2.0 | [1/2] (16/1) | double structure plate-like grain |

TABLE 1-continued

| | Average AgI content (mole %) | Average equivalent-sphere diameter (μm) | Variation coefficient of grain distribution (%) | Ratio of diameter/thickness | Silver amount ratio [core/intermediate/shell] (AgI content) | Grain structure and shape |
|---|---|---|---|---|---|---|
| Emulsion C | 7.0 | 0.65 | 23 | 2.2 | [3/5/2] (0/14/7) | triple structure plate-like grain |
| Emulsion D | 10.0 | 0.65 | 15 | 3.5 | [12/59/29] (0/12/6) | triple structure tabular grain |
| Emulsion E | 3.5 | 0.35 | 25 | 2.8 | — | uniform structure plate-like grains |
| Emulsion F | 4.0 | 0.50 | 18 | 4.0 | — | uniform structure tabular grains |
| Emulsion G | 3.5 | 0.55 | 15 | 3.5 | [12/59/29] (0/5/2) | triple structure tabular grain |
| Emulsion H | 10.0 | 0.70 | 20 | 5.5 | [12/59/29] (0/13/8) | triple structure tabular grain |
| Emulsion I | 3.8 | 0.70 | 15 | 3.5 | [12/59/29] (0/5/3) | triple structure tabular grain |
| Emulsion J | 8.0 | 0.65 | 28 | 2.5 | [1/2] (18/3) | double structure plate-like grain |
| Emulsion K | 10.3 | 0.40 | 15 | 1.0 | [1/3] (29/4) | double structure octahedral grain |
| Emulsion L | 9.0 | 0.66 | 19 | 5.8 | [8/59/33] (0/11/8) | triple structure tabular grain |
| Emulsion M | 2.5 | 0.46 | 30 | 7.0 | — | uniform structure tabular grains |
| Emulsion N | 13.9 | 1.30 | 25 | 3.0 | [7/13] (34/3) | double structure plate-like grain |
| Emulsion O | 2.0 | 0.07 | 15 | 1.0 | — | uniform structure fine grain |

In Table 1, (1) Emulsions A–N had been subjected to reduction-sensitization during preparation of grains, using thiourea dioxide and thiosulfonic acid, in accordance with the Examples disclosed in JP-A-2-191938.

(2) Emulsions A–N had been subjected to gold-sensitization, sulfur-sensitization, and selenium-sensitization in the presence of the spectral sensitizing dye and sodium thiocyanate for each light-sensitive layer, in accordance with the Examples disclosed in JP-A-3-237450.

(3) For preparation of tabular grains, low molecular weight gelatin had been used in accordance with the Examples set forth in JP-A-1-158426.

(4) In tabular grains and regular crystal grains having a grain structure, dislocation lines as described in JP-A-3-237450 were observed using a high voltage electron microscope.

(5) Emulsions A–N contained iridium in the interior of each grain by the method described in B. H. Carroll, *Photographic Science and Engineering*, 24, 265 (1980).

The substances used in Sample 101 are indicated below:

UV-1

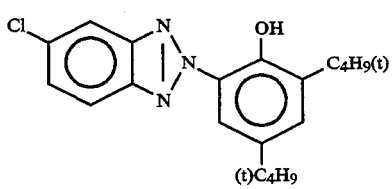

UV-2

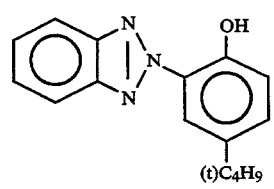

UV-3

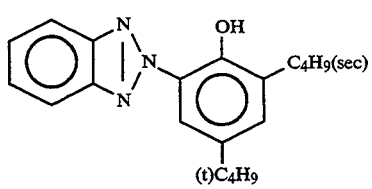

UV-4

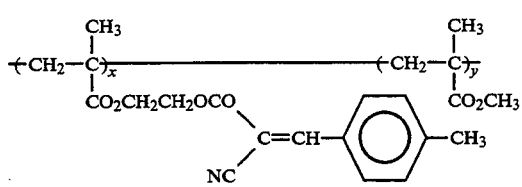

x:y = 70:30 (wt %)

-continued
UV-5
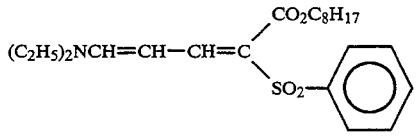
ExF-1
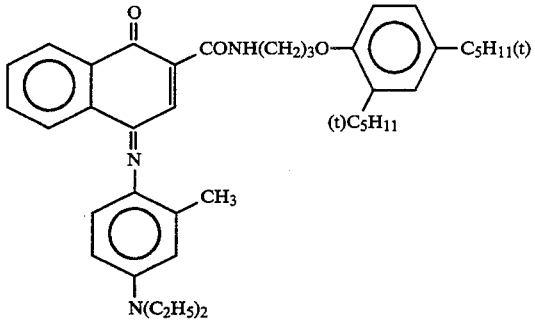
ExF-2
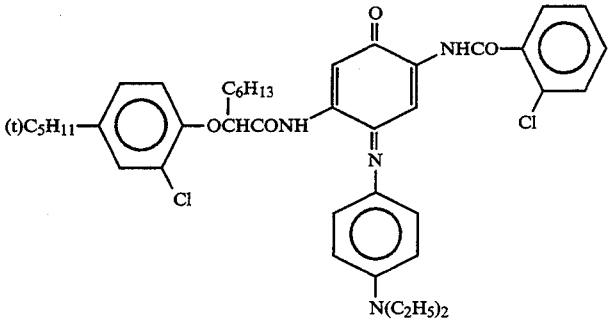
ExF-3
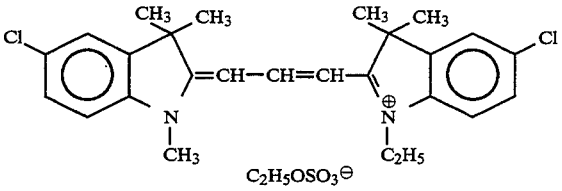
ExC-1
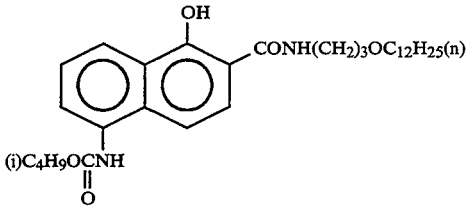

-continued
ExC-2
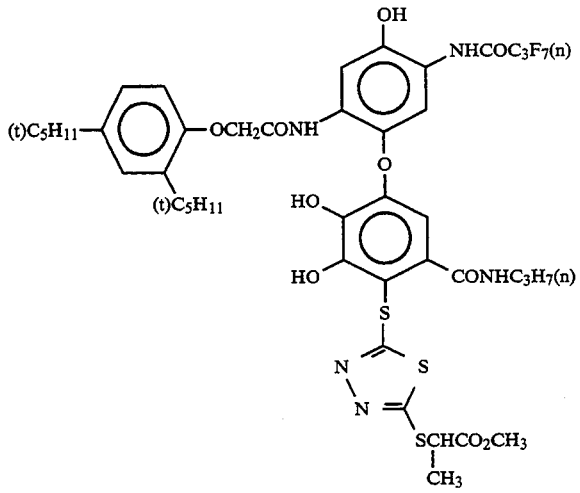
(same as Cp—N in Example 2 of JP-A-2-90151)
ExC-3
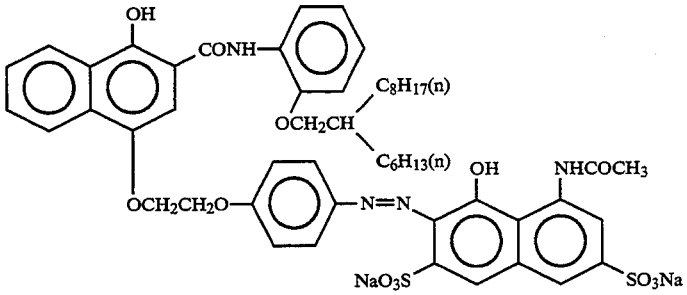
same as exemplified compound (1)
ExC-4
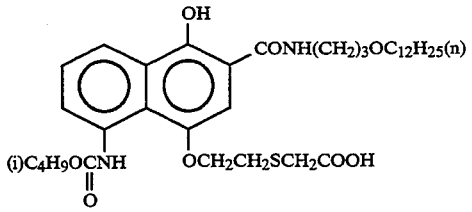
ExC-5
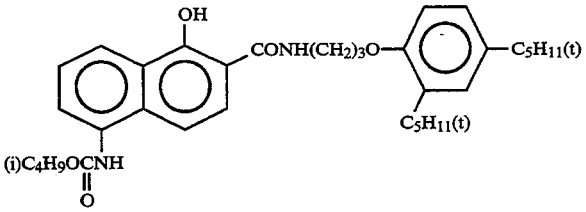
ExC-7
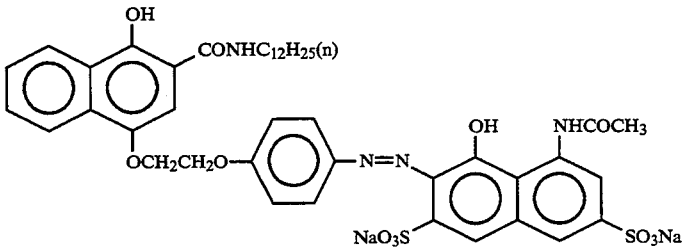
same as exemplified compound (III-3)

-continued
ExC-8
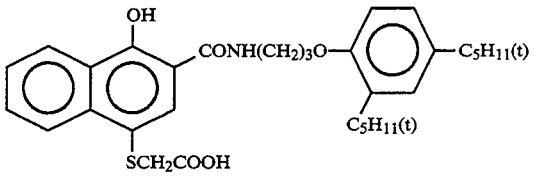
ExC-9
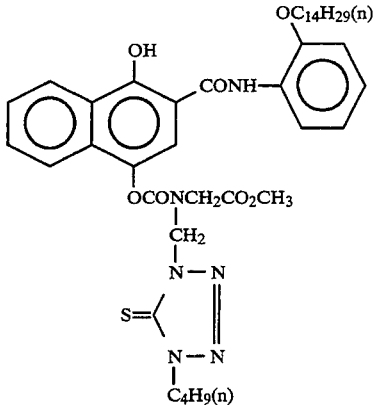
ExM-1
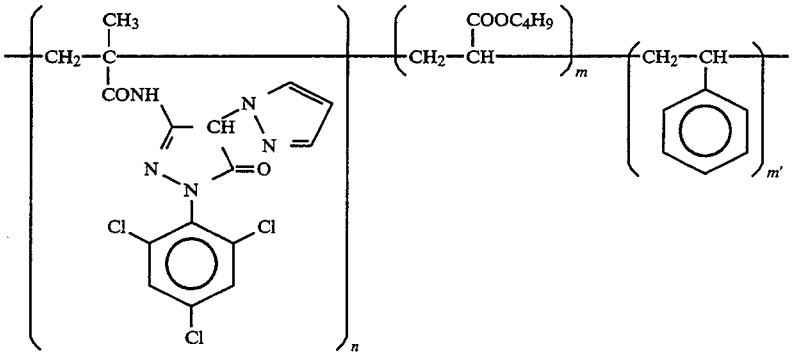
n = 50
m = 25
m' = 25
mol. wt. about 20,000
same as exemplified compound (m-13)
ExM-2
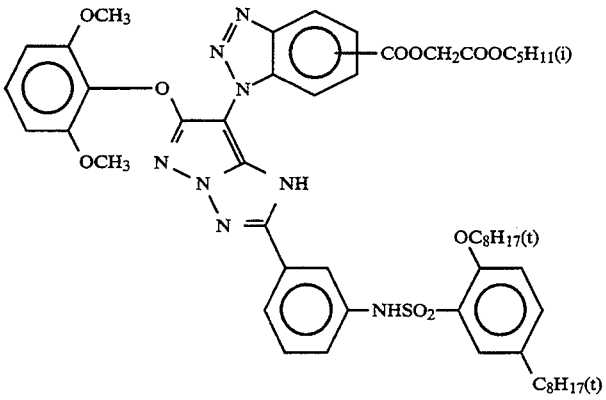

-continued
ExM-3
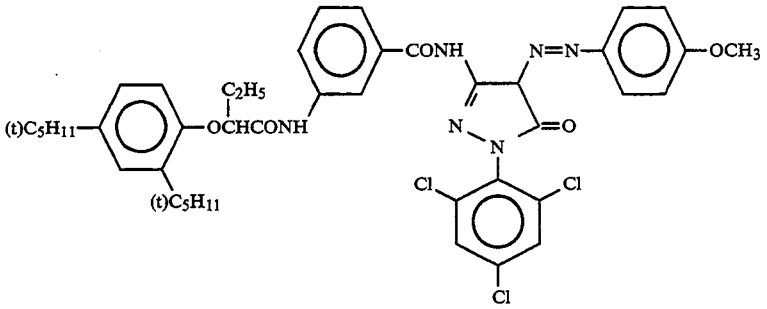
ExM-4
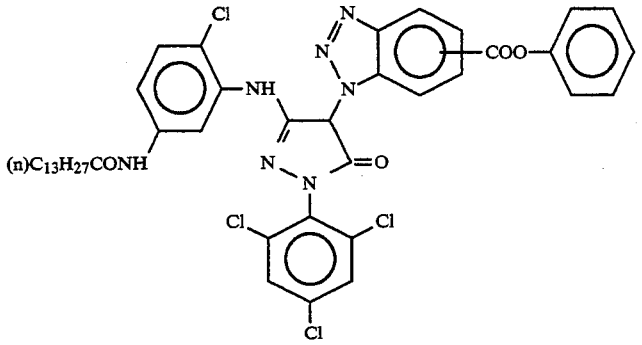
ExM-5
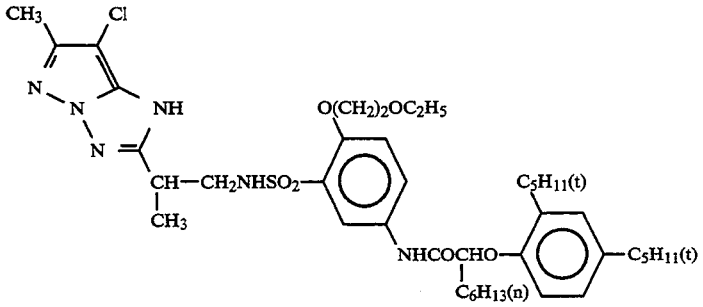
same as exemplified compound (M-12)
ExM-6
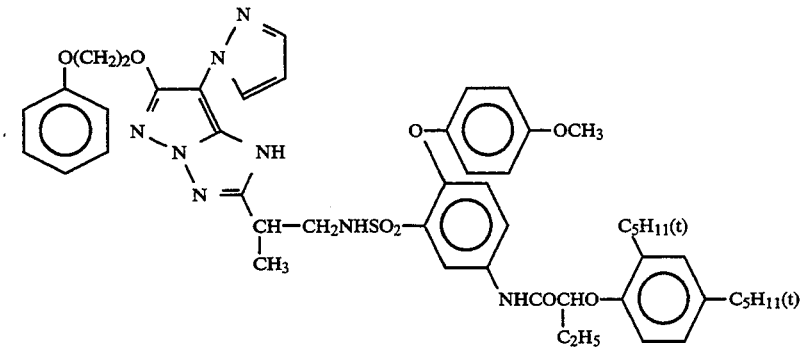
same as exemplified compound (M-13)

-continued
ExM-7
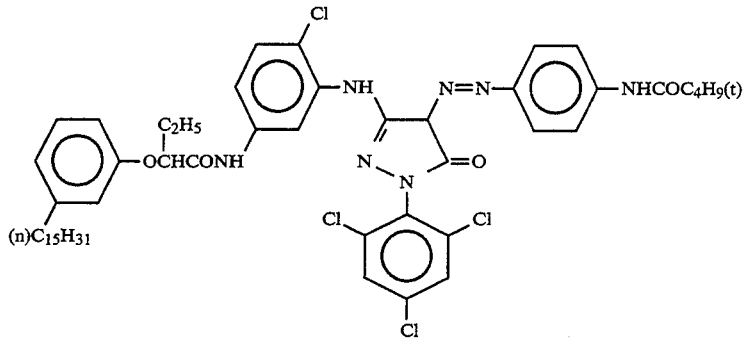
ExY-1
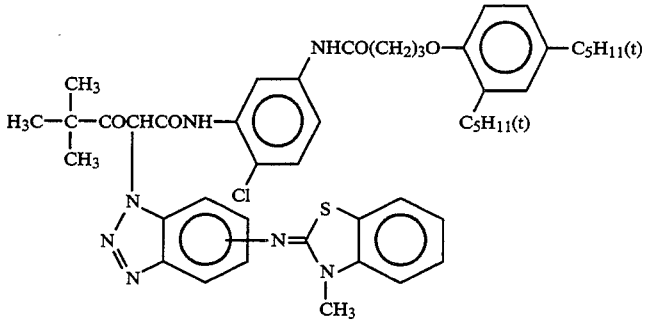
ExY-2
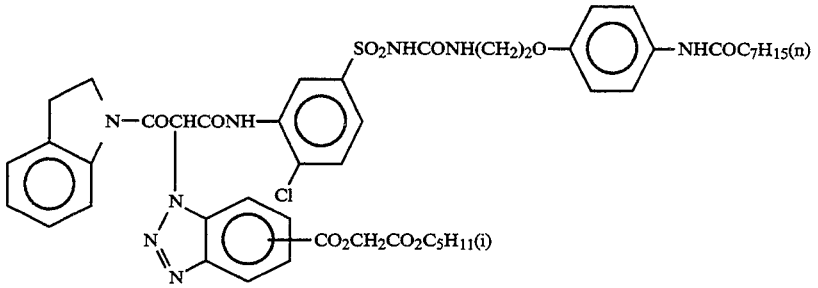
ExY-3
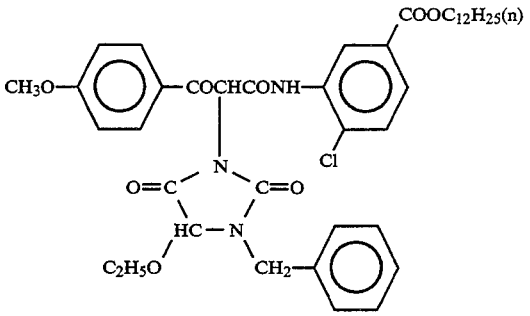
ExY-4
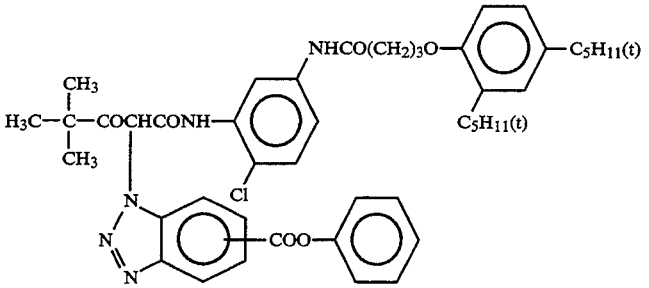

-continued
ExY-5
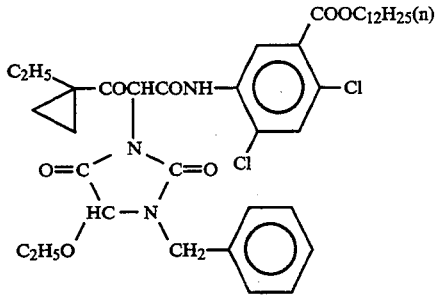
Cpd-1
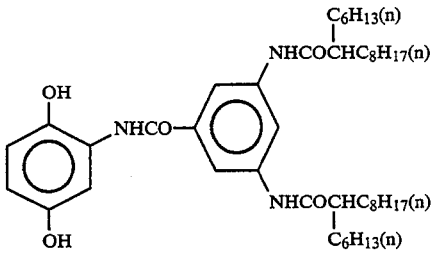
Cpd-2
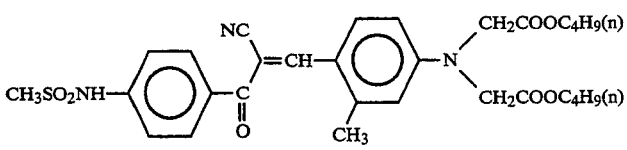
Cpd-3
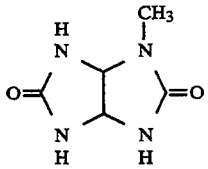
Cpd-4
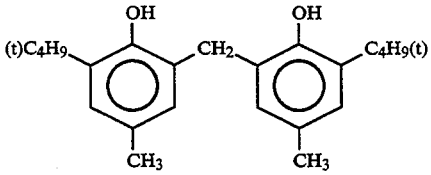
Cpd-5
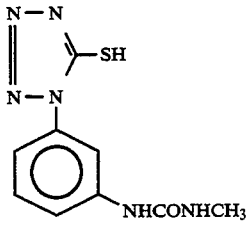
Cpd-6
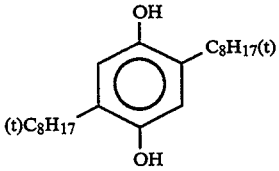
Solv-1
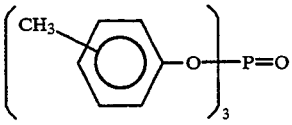
Solv-2
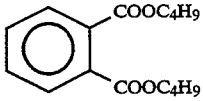
Solv-3
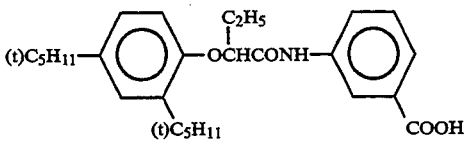
Solv-4
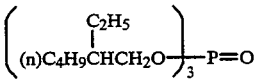
Solv-5
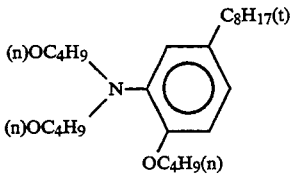
ExS-1
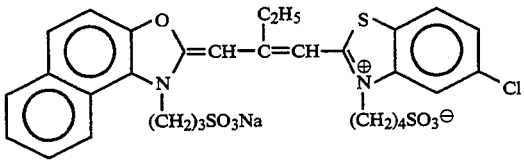

-continued
ExS-2
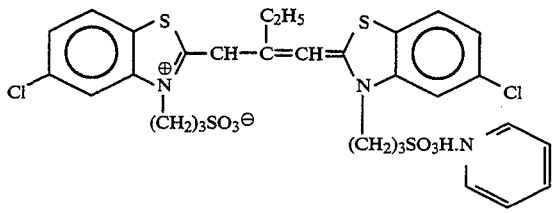
ExS-3
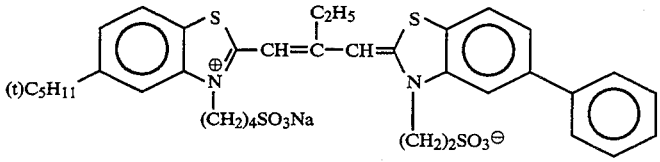
ExS-4
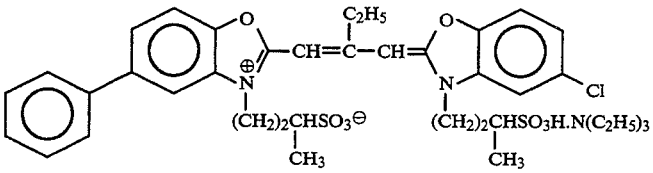
ExS-5
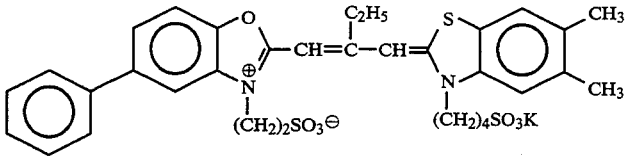
ExS-6
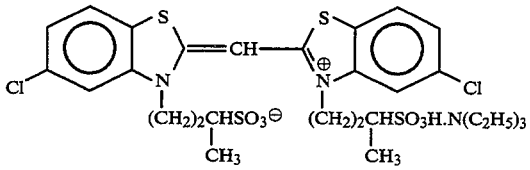
ExS-7
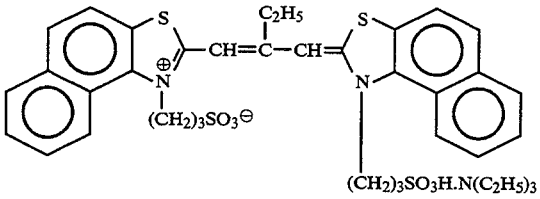
ExS-8
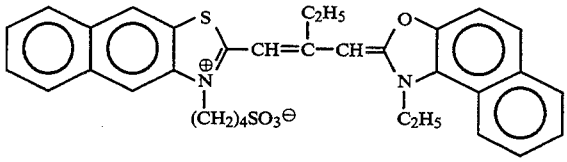
H-1
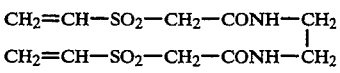
W-1
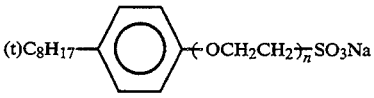
n = 2 to 4
W-2
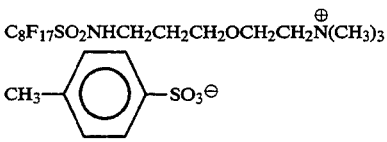
W-3
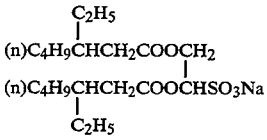

-continued
W-4
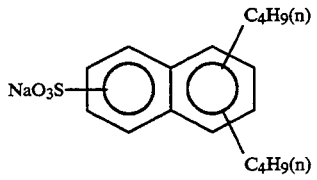
W-5
$C_8F_{17}SO_2N(C_3H_7)CH_2COOK$
W-6
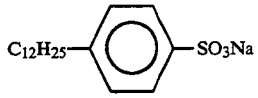
B-1
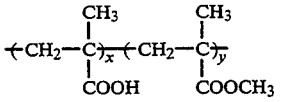
x/y = 10/90
B-2
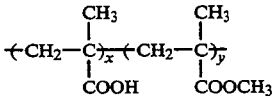
x/y = 40/60
B-3
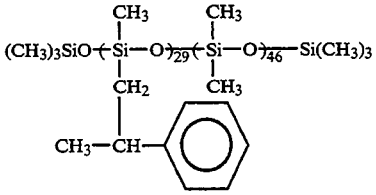
B-4
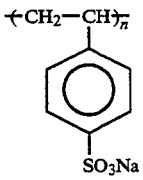
B-5
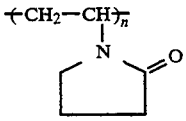
(mol. wt. about 10,000)
B-6
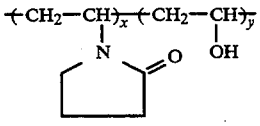
x/y = 70/30
F-1
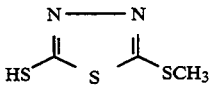
F-2
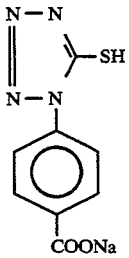
F-3
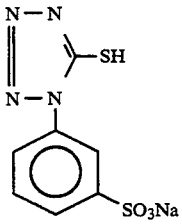
F-4
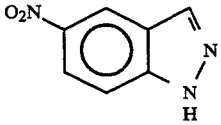
F-5
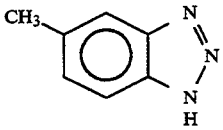
F-6
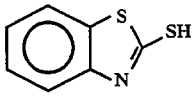
F-7
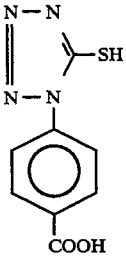
F-8
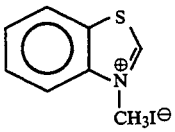
F-9
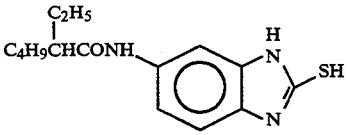

-continued

F-10

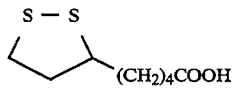

F-11

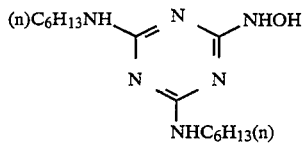

F-12

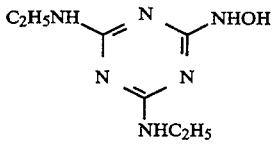

F-13

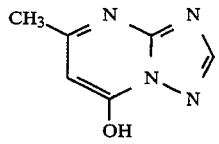

F-14

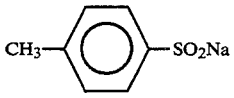

F-15

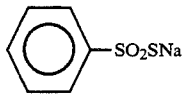

F-16

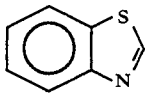

(Preparation of Sample 102)

A sample 102 was prepared in the same manner as the sample 101 except that $5.3\times10^{-2}$ of ExC-3, and $4.6\times10^{-2}$ of ExC-3 were added to the layers 2 and 3, respectively.

(Preparation of Sample 103)

A sample 103 was prepared in the same manner as the sample 101 except that $1.5\times10^{-2}$ of ExM-1 was added to the layer 4.

(Preparation of Sample 104)

A sample 104 was prepared in the same manner as the sample 103 except that $6.0\times10^{-2}$ of ExC-3, and $5.4\times10^{-2}$ of ExC-3 were added to the layers 2 and 3, respectively.

(Preparation of Sample 105)

A sample 105 was prepared in the same manner as the sample 104 except that the ExC-3 were removed from the layers 2 and 3, and $5.3\times10^{-2}$ and $6.1\times10^{-2}$ of ExC-7 were respectively added to the layers 2 and 3.

(Preparation of Sample 106)

A sample 106 was prepared in the same manner as the sample 104 except that ExM-1 was removed from the layer 4, and $1.7\times10^{-2}$ of ExM-5 was added thereto instead.

(Preparation of Sample 107)

A sample 107 was prepared in the same manner as the sample 102 except that $2.0\times10^{-2}$ of ExC-3 out of $4.6\times10^{-2}$ in the layer 3 was transferred to the layer 4.

Samples 101–107 thus prepared were evaluated as follows:

Each of the samples 101–107 was exposed to white light through a silver wedge, and then subjected to the following development process. Densities were obtained as the status M density of each of blue, green, and red, and from the characteristic curve, the sensitivity of each sample was obtained. The sensitivity was expressed by a reciprocal of the exposure amount required to give a density of fog +0.3, with that of sample 100 assumed 100.

Further, the sharpness of each sample at 10 cycle/mm was obtained by the general MTF method.

Next, using the samples 101–107, from-the-waist-up portrait photographs of a woman were taken. The camera used was EOS-10 of Canon. After the above-mentioned process was performed, print samples were formed using Automatic Color Printer FAP 3500 of FUJI PHOTO FILM as a printer, and Fuji Color Super FA Paper of FUJI PHOTO FILM as a print material.

The print samples were evaluated by ten male and ten female observers.

The results were indicated in Table 2.

The development process was carried out in the following manner.

1. Color development . . . 3 min 15 sec, 38.0° C.±0.1° C.
2. Bleaching . . . 6 min 30 sec, 38.0° C.±3.0° C.
3. Water-washing . . . 3 min 15 sec, 24°–41° C.
4. Fixing . . . 6 min 30 sec, 38.0° C.±3.0° C.
5. Water-washing . . . 3 min 15 sec, 24°–41° C.
6. Stabilization . . . 3 min 15 sec, 38.0° C.±3.0° C.
7. Drying . . . 50° C. or lower The compositions of the respective processing solutions used in each step were as follows:

| | |
|---|---|
| Color Development Solution | |
| Diethylenetriaminepentaacetic acid | 1.0 g |
| 1-hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-ethyl-N-p-hydroxyethylamino)-2-methylaniline sulfate | 4.5 g |
| Water to make | 1.0 liter |
| pH | 10.05 |
| Bleach solution | |
| Ammonium FE(III) ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing solution | |
| Disodium ethylenediaminetetraacetate | 10 g |
| Sodium sulfite | 4.0 g |
| Ammonium thiosulfate aqueous solution (70%) | 175.0 ml |
| Sodium bisulfite | 4.6 g |
| Water to make | 1.0 liter |
| pH | 6.6 |

-continued

| Stabilizing Solution | |
|---|---|
| Formalin (40%) | 2.0 ml |
| Polyoxyethylene-p-monononylphenyl ether (av. polymerization degree: 10) | 0.3 g |
| Water to make | 1.0 liter |

TABLE 2

| Sample No. | Sensitivity of red-sensitive layer | Sensitivity of green-sensitive layer | MTF sharpness of green sensitive layer [10 c/mm] | Evaluation of printing quality* | |
|---|---|---|---|---|---|
| 101 | 100 | 100 | 100 | 3.0 | comparative example |
| 102 | 95 | 95 | 106 | 3.7 | comparative example |
| 103 | 102 | 106 | 98 | 2.5 | comparative example |
| 104 | 99 | 102 | 110 | 4.5 | present invention |
| 105 | 101 | 103 | 111 | 4.6 | present invention |
| 106 | 100 | 102 | 111 | 4.5 | present invention |
| 107 | 85 | 87 | 106 | 3.4 | comparative example |

*The Printing quality is indicated by an averaged evaluation score based on the following scoring system:
1 . . . poor, 2 . . . slightly poor, 3 . . . average, 4 . . . good, 5 . . . very good As can be understood from Table 2, satisfactory performances cannot be achieved by simply adding a magenta coupler to the highest sensitivity layer of the red-sensitive layers, or a magenta colored cyan coupler to the red-sensitive layers, as hitherto known, but the sensitivity, sharpness, and printing quality can be upgraded by the the present invention, which appears to be contradictory, i.e. a magenta coupler is added along with a cyan coupler to the highest sensitivity layer of the red-sensitive layers, and a magenta colored cyan coupler is added along with a cyan coupler to a layer having a lower sensitivity.

EXAMPLE 2

Samples were prepared from the samples 101–106 in Example 1 by removing ExC-2 and ExC-9 from the layers 2 and 3, respectively, and were evaluated in a similar manner to that of Example 1. Results similar to those of Example 1 were obtained. However, the advantages of the invention were more significant in Example 1 than Example 2, and it was found that a compound releasing a diffusing development inhibitor should preferably be contained in a red-sensitive silver halide emulsion layer having a lower sensitivity.

EXAMPLE 3

Each of the samples 101–106 of Example 1 was formed into the form of "UTSURUNDESU FLASH" (film unit equipped with a lens) of FUJI PHOTO FILM CO., and photographs of the same type as Example 1 were taken by use of each film unit, in place of EOS10 of Example 1, and evaluated.

In this example, the samples of the present invention exhibited a good printing quality, indicating a significant advantage.

What is claimed is:

1. A silver halide color photographic light-sensitive material comprising, on a support, at least one green-sensitive silver halide emulsion layer containing a magenta coupler, at least one blue-sensitive silver halide emulsion layer containing a yellow coupler, and at least two red-sensitive silver halide emulsion layers each containing a cyan coupler and having different sensitivities, wherein a highest sensitivity red-sensitive emulsion layer of said red-sensitive silver halide emulsion layers contains a magenta coupler, and a red-sensitive emulsion layer having a lower sensitivity than that of said highest sensitivity red-sensitive emulsion layer contains a magenta colored cyan coupler.

2. The light-sensitive material according to claim 1, wherein a red-sensitive silver halide emulsion layer having a lower sensitivity contains at least one compound which releases a diffusible development inhibitor or a precursor thereof upon reacting with an oxide form of a developing agent, or which cleaves to form another compound after reacting with an oxidized form of a developing agent, which cleaved compound in turn reacts with another molecule of the oxide form of the developing agent to release a development inhibiter.

3. The light-sensitive material according to claim 1, wherein said magenta colored cyan coupler is represented by Formula (I) below:

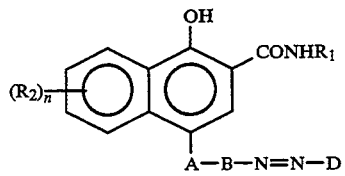

Formula (I)

where $R_1$ represents an aromatic group or a heterocyclic group; $R_2$ represents a group substitutable on the naphthol ring; A—B—N=N—D represents a coupling split-off group; A represents a divalent group, bonding of which with the carbon atom at the coupling active site of the coupler represented by formula (I) is cleaved upon a reaction between the coupler and an oxidized form of a color developing agent; B represents a divalent aromatic group or heterocyclic group; D represents an aromatic group or a heterocyclic group; and n is an integer from 0 to 4.

4. The light-sensitive material according to claim 2, wherein said magenta colored cyan coupler is represented by Formula (I) below:

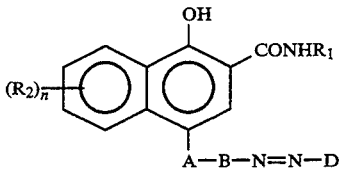

Formula (I)

where $R_1$ represents an aromatic group or a heterocyclic group; $R_2$ represents a group substitutable on the naphthol ring; A—B—N=N—D represents a coupling split-off group; A represents a divalent group, bonding of which with the carbon atom at the coupling active site of the coupler represented by formula (I) is cleaved upon a reaction between the coupler and an oxidized form of a color developing agent; B represents a divalent aromatic group or heterocyclic group; D represents an aromatic group of a heterocyclic group; and n is an integer from 0 to 4.

5. The light-sensitive material according to claim 1, wherein said magenta coupler in the highest sensitivity red-sensitive emulsion layer is represented by Formula (m) or Formula (M) below:

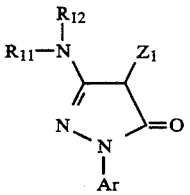

Formula (m)

where $R_{11}$ represents an alkyl group, an aryl group, an aryl group, or a carbamoyl group; $R_{12}$ represents a hydrogen atom, an acyl group, or an acyl group; $R_{11}$ and $R_{12}$ may combine with each other to form a ring; Ar represents phenyl group, or a phenyl group substituted with one or more of a halogen atom, an alkyl group, a cyano group, an alkoxy group, an alkoxycarbonyl group or an acylamino group; $Z_1$ represents a hydrogen atom or a group which can be split-off upon reacting with an oxidized form of an aromatic primary amine color developing agent;

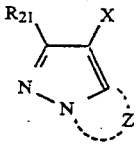

Formula (M)

where $R_{21}$ represents a hydrogen atom, or a substituent; Z represents a non-metallic atomic group required to form a 5-membered azole ring having 2 to 4 nitrogen atoms, wherein the azole ring may contain a substituent, and may include a fused ring; and X represents a hydrogen atom or a group which can be split-off upon a coupling reaction with an oxidized form of a developing agent.

6. The light-sensitive material according to claim 2, wherein said magenta coupler in the highest sensitivity red-sensitive emulsion layer is represented by Formula (m) or Formula (M) below:

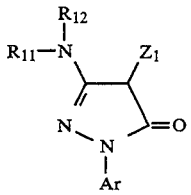

Formula (m)

where $R_{11}$ represents an alkyl group, an aryl group, an aryl group, or a carbamoyl group; $R_{12}$ represents a hydrogen atom, an acyl group, or an acyl group; $R_{11}$ and $R_{12}$ may combine with each other to form a ring; Ar represents phenyl group, or a phenyl group substituted with one or more of a halogen atom, an alkyl group, a cyano group, an alkoxy group, an alkoxycarbonyl group or an acylamino group; $Z_1$ represents a hydrogen atom or a group which can be split-off upon reacting with an oxidized form of an aromatic primary amine color developing agent;

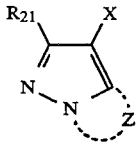

Formula (M)

where $R_{21}$ represents a hydrogen atom, or a substituent; Z represents a non-metallic atomic group required to form a 5-membered azole ring having 2 to 4 nitrogen atoms, wherein the azole ring may contain a substituent, and may include a fused ring; and X represents a hydrogen atom or a group which can be split-off upon a coupling reaction with an oxidized form of a developing agent.

7. The light-sensitive material according to claim 1, wherein a ratio of the magenta coupler to the cyan coupler in the highest sensitivity layer of the red-sensitive emulsion layers is 5 mole % to 100 mole %.

8. The light-sensitive material according to claim 1, wherein a ratio of the magenta coupler to the cyan coupler in the highest sensitivity layer of the red-sensitive emulsion layers is 7 mole % to 80 mole %.

9. The light-sensitive material according to claim 1, wherein a ratio of the magenta coupler to the cyan coupler in a red-sensitive silver halide emulsion layer having a lower sensitivity is 2 mole % to 50 mole %.

10. The light-sensitive material according to claim 1, wherein a ratio of the magenta according to claim 1, wherein a ratio of the magenta coupler to the cyan coupler in a red-sensitive silver halide emulsion layer having a lower sensitivity is 4 mole % to 40 mole' %.

11. The light-sensitive material according to claim 1, wherein the material contains at least three red-sensitive layers of different sensitivity, and the red-sensitive layers other than the highest red-sensitive layer each contains a magenta colored cyan coupler and a cyan coupler, and in the red-sensitive layers other than the highest red-sensitive layer, the lower the sensitivity of the red-sensitive emulsion layer is, the higher is the ratio of the magenta colored cyan coupler to the cyan coupler.

12. The light-sensitive material according to claim 2, wherein said compound is represented by formula (XI) below:

$$A\text{-}(TIME)_a\text{-}DI$$

Formula (XI)

where A represents a group which splits off $(TIME)_a$-DI upon reaction with an oxidized form of an aromatic primary amine color developing agent; TIME represents a timing group which cleaves DI after released from A; DI represents a development inhibitor; a is 0, 1, or 2, and when a is two, two TIMEs may be the same or different.

13. The light-sensitive material according to claim 2, wherein said compound is represented by formula (XII) below.

$$A\text{-}(TIME)_i\text{-}RED\text{-}DI \qquad \text{Formula (XII)}$$

where A represents a group which splits off $(TIME)_i$-RED-DI upon reaction with an oxidized form of an aromatic primary amine color developing agent; TIME represents a timing group which cleaves RED-DI after released from A; RED represents a group which cleaves DI by reacting with an oxidized form of a developing agent after released from A or TIME; DI represents a development inhibitor; and i is 0 or 1.

* * * * *